US006536812B1

(12) United States Patent
Winardi

(10) Patent No.: US 6,536,812 B1
(45) Date of Patent: Mar. 25, 2003

(54) ADJUSTABLE-BACKSET LATCH SYSTEM FOR LOCKSETS, AND METHOD

(75) Inventor: Michael Winardi, Fullerton, CA (US)

(73) Assignee: NewFrey LLC, Newark, DE (US)

( * ) Notice: Subject to any disclaimer, the term of this patent is extended or adjusted under 35 U.S.C. 154(b) by 0 days.

(21) Appl. No.: 09/636,489

(22) Filed: Aug. 11, 2000

Related U.S. Application Data

(60) Provisional application No. 60/148,980, filed on Aug. 13, 1999.

(51) Int. Cl.[7] ..... E05C 1/00

(52) U.S. Cl. ..... 292/1.5; 292/DIG. 60

(58) Field of Search ..... 292/1.5, 337, DIG. 60

(56) References Cited

U.S. PATENT DOCUMENTS 4,038,726 A * 8/1977 Takabayashi ..... 24/198
4,593,542 A * 6/1986 Rotondi ..... 70/134
4,602,490 A 7/1986 Glass et al.
4,639,025 A 1/1987 Fann et al.
4,653,787 A 3/1987 Fang
4,656,849 A 4/1987 Rotondi et al.
4,708,379 A 11/1987 Ching
4,729,586 A 3/1988 Fang
4,736,973 A 4/1988 Fang
4,768,817 A 9/1988 Fann et al.
4,772,055 A 9/1988 Fang
4,902,057 A 2/1990 Ching
4,957,315 A * 9/1990 Lin ..... 292/337
4,976,122 A 12/1990 Doolan et al.
5,149,151 A * 9/1992 Shen ..... 292/1.5
5,456,503 A 10/1995 Russell, IV
5,498,037 A 3/1996 Fan
5,562,314 A * 10/1996 Wheatland ..... 292/1.5
5,647,617 A * 7/1997 Kajuch ..... 292/1.5
5,944,366 A * 8/1999 Aramburu ..... 292/1.5

* cited by examiner

*Primary Examiner*—Gary Estremsky
(74) *Attorney, Agent, or Firm*—Richard J. Veltman; John D. Del Ponti

(57) ABSTRACT

An adjustable-backset latch system for a lockset includes three main subsystems: a bolt retraction system, a backset-adjustment system and a deadlatching system. By virtue of the simplicity of the design of the backset-adjustment subsystem, the user can change the backset from 2⅜" to 2¾", and vice-versa with one hand. A pin is simply moved through a "U"-shaped slot formed in a housing and housing and bolt actuation components are extended simultaneously by the desired backset increment. The bolt retraction system of the present invention uses a cam in which the distance from a point about which the cam rotates and the end of the cam, and the distance to a smaller cam pin, are selected to multiply the relatively small angular distance transversed during a half-round rotation of the knob or handle into the desired retraction distance of a main bolt. The deadlatching system uses two springs, one of which not only biases an auxiliary bolt to its extended position, but also biases a deadlocking dog so as to pivot into a blocking position preventing the main bolt from being retracted completely, in the event an intruder attempts to move the bolt.

53 Claims, 22 Drawing Sheets

ADJUSTABLE-BACKSET LATCH SYSTEM FOR LOCKSETS, AND METHOD

CROSS-REFERENCE TO RELATED APPLICATION

This application is based upon and claims priority to U.S. Provisional Patent Application Serial No. 60/148,980 filed Aug. 13, 1999, and entitled "Adjustable Backset Latch Mechanism", the specification and drawings of which are herein expressly incorporated by reference.

FIELD OF THE INVENTION

The invention relates to an adjustable-backset latch system for locksets, and a method for adjusting backset and assembling the latch system. The latch system enables the user to quickly change a backset by the usual backset increment of ⅜" by simply moving a pin through a "U"-shaped slot in a housing member without having to rotate any of the components of the backset latch system. The invention also includes improved deadlatching and bolt retraction systems. The invention also includes the combination of the latch system with a lockset.

BACKGROUND OF THE INVENTION

Existing latch arrangements for varying the backset from 2⅜" to 2¾" (and vice-versa) for locksets using both deadbolts and deadlatching systems are well known. Conventional adjustable-backset latch systems have one or more of the following characteristics. The backset adjustment is not easy to use; there are loose parts, often contributing to jamming. They do not fit into a ⅞" diameter hole; they do not interface with half-round spindles in a pull-type fashion using horizontal stems extending from the lockset rose or rose liner. In addition, by locating the backset-adjusting components near the inward half of the latch, not enough material is left in the latch subassembly for a ⅞" latch to provide the desired structural strength to meet Grade 2 standards specified under ANSI/BHMA 156.2. Furthermore, their design is such that if the various actions and cooperation does not occur in proper sequence, the mechanism jams. In other cases, the user must rotate one part of the latch system relative to another to move both a housing portion and a bolt portion simultaneously by the same backset distance, a maneuver which usually takes two hands. In other systems, parts are removeable, and are easily lost. Still others are not easily retrofittable for existing installations unless further modifications to the existing locksets are made. Still further, they may be designed in such a way as to make it difficult to automate the manufacturing or assembly of their components. In short, there is a need for a Grade 2 adjustable backset latch system for a pull-type mechanism (in which linkages move in the same direction as bolt retraction) that is strong and durable. There is still another need for a backset latch system in which the backset may be quickly adjusted by the user with a motion of just one hand. Also, the latch system needs to be designed in such a way as to be easily assembled using automated procedures. Finally, there exists a need for an adjustable backset latch system in which the timing and operation of the respective components are consistently reliable.

SUMMARY OF THE INVENTION

Accordingly, it is a particular object of the preferred embodiments of the invention to provide an adjustable-backset latch system, and method, in which the user need only move a detent pin along a "U"-shaped slot in the latch housing to change the backset, without affecting the ability of a bolt operator to retract the latch bolt. It is another object of the present invention to provide a unique adjuster for coordinating the timing and operation of a bolt retraction system and a backset adjustment system. It is still another object of the present invention to provide an improved deadlatching system in which a deadlocking dog cooperates with a housing and a latch bolt and an auxiliary bolt to reliably and consistently provide the deadlatching function. It is still another object of the present invention to enable the components of the system of the present invention to be assembled using automated manufacturing techniques. It is still another object of the present invention to provide methods for the user to retract the bolt and adjust the backset of the systems of the present invention. A feature by which the above objects can be obtained is by providing a resilient adjuster mounted in one of a set of inner and outer cases which releasably couples the inner and outer cases and front and back links, which together make up a bolt actuator. Preferably, the adjuster includes a member which is engageable by a person to cause the adjuster both to uncouple the cases and links, and to simultaneously adjust the links and cases by a predetermined backset increment. Another feature by which the above objects can be attained is by providing a bolt actuation system in which the bolt actuator, responsive to rotation of a bolt operator retracts a linkage that pulls a cam against a portion of the bolt, in such a manner as to multiply the linear travel of the bolt operator to achieve complete bolt retraction. Still another feature by which the above objects can be attained is by providing a deadlatching system in which a spring dog is mounted between a deadlocking dog and an auxiliary bolt such that not only is the auxiliary bolt biased normally to its extended position, but the deadlocking dog is simultaneously biased to a position which blocks the retraction of a main bolt. Still other features by which the above objects may be attained is by forming fastener clearance holes in both the housing and the adjuster, thereby yielding a compact yet structurally sound system.

And furthermore, still another object of the present invention is to provide a lockset having one or more handles and knobs which uses one or more elements of the adjuster-backset latch of the present invention.

Other objects, features and advantages of the present invention will become more fully apparent from the following detailed description of the preferred embodiments, the appended claims and the accompanying drawings.

BRIEF DESCRIPTION OF THE DRAWINGS

In the accompanying drawings, in which like reference characters in the same or different Figures, indicate like parts:

FIGS. 10 and 11 are sectional detail views of the backset set at 2⅜" with the detent pin "up", FIGS. 12 and 13 are sectional detail views of the backset adjustment system set at the 2⅜" backset, with the detent pin "down";

FIGS. 14 and 15 are sectional detail views of the backset adjustment system of the present invention with the 2⅜" backset, during adjustment;

FIGS. 16 and 17 are sectional detail views of the backset adjustment system of the present invention set at a 2¾" backset with the detent pin "down";

FIGS. 18 and 19 are sectional detail views of the backset adjustment system of the present invention set at 2¾" backset, with the detent pin "up";

DETAILED DESCRIPTION OF THE PREFERRED EMBODIMENTS

Figure 1:
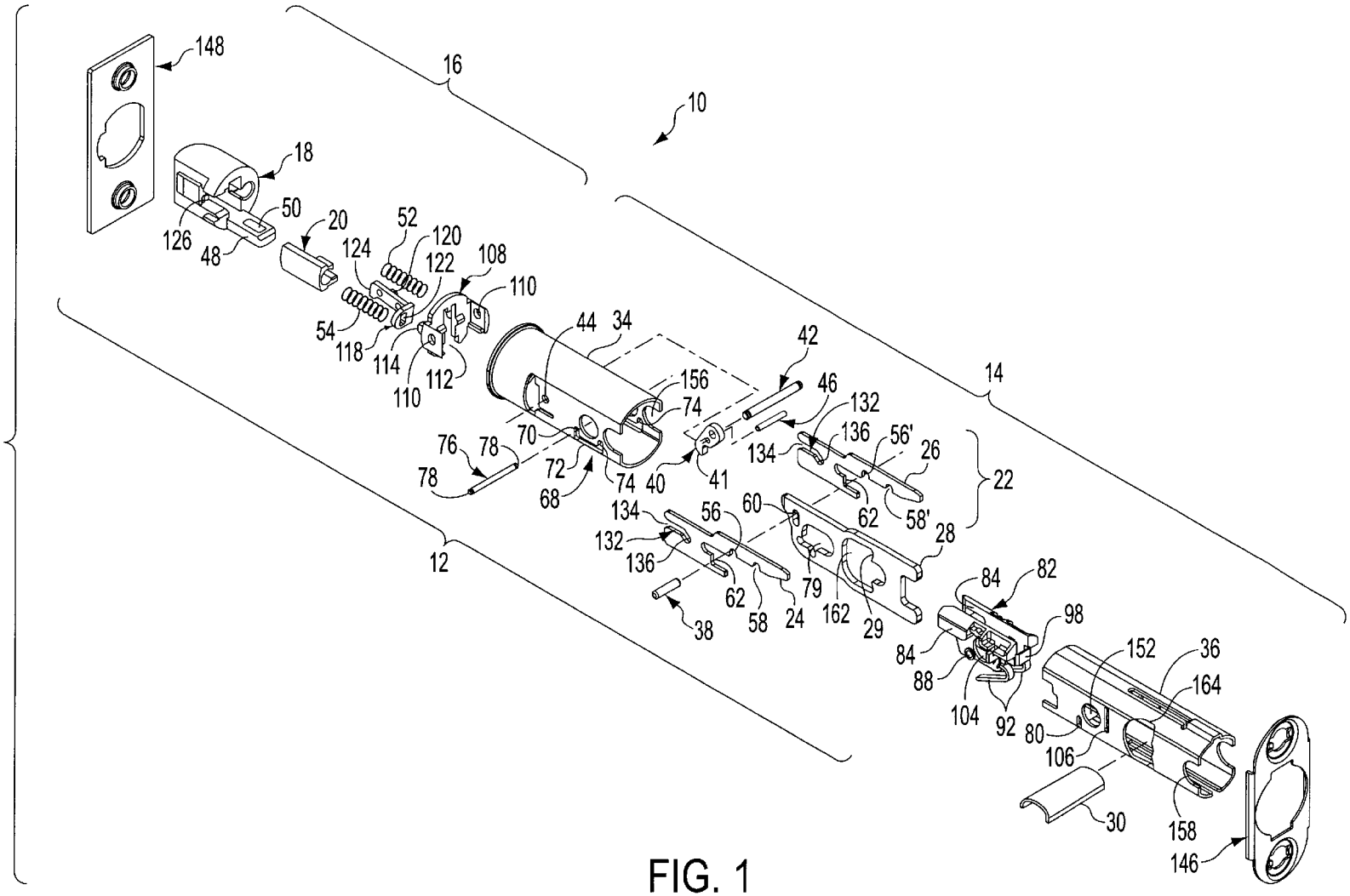
FIG. 1 is a exploded perspective view of the adjustable backset latch mechanism of the present invention, schematically showing the bolt operator or "half-round"
Figure 2:
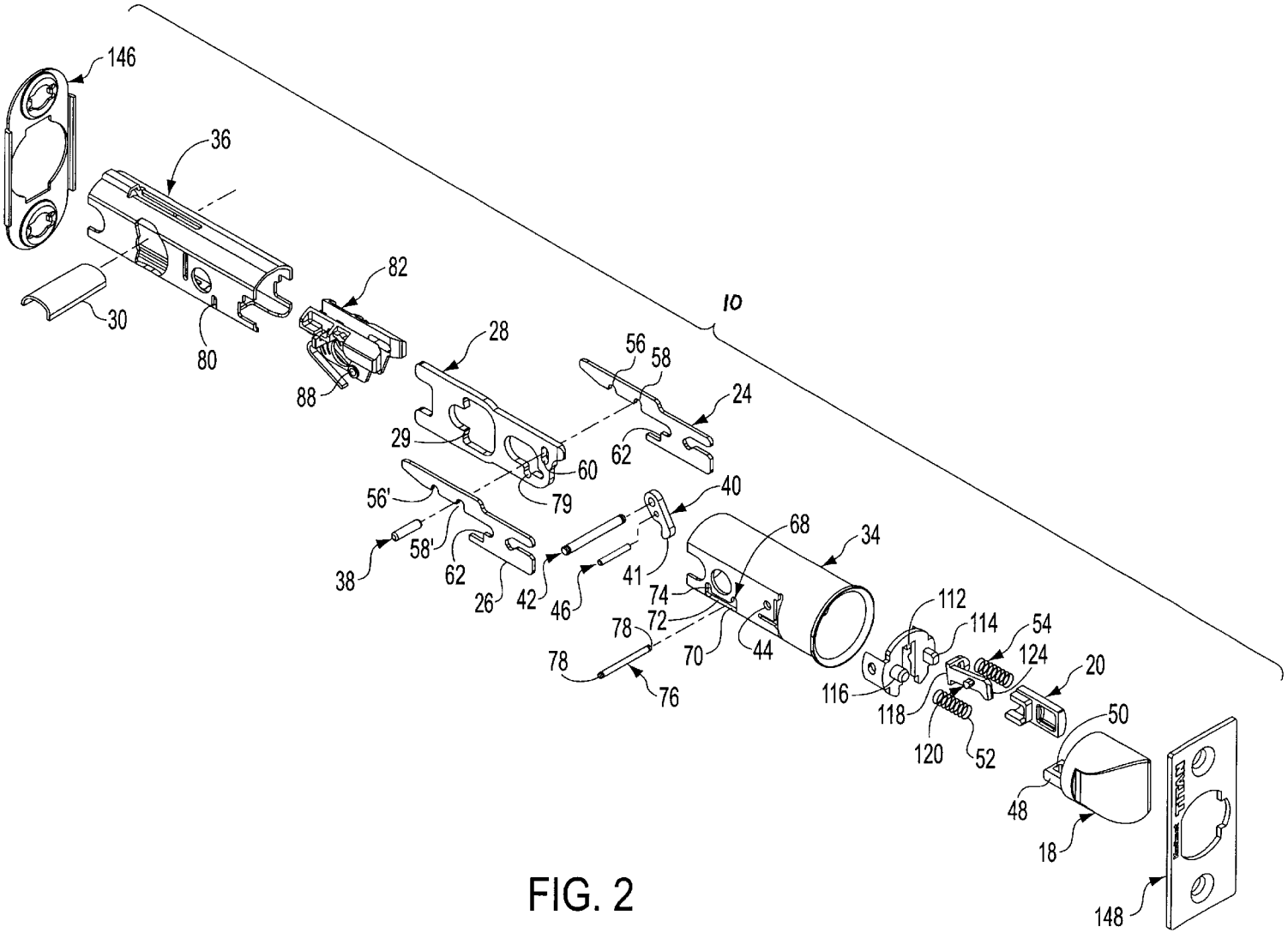
FIG. 2 is an exploded perspective view of the adjustable backset of FIG. 1, rotated 180 degrees.
Figure 35:
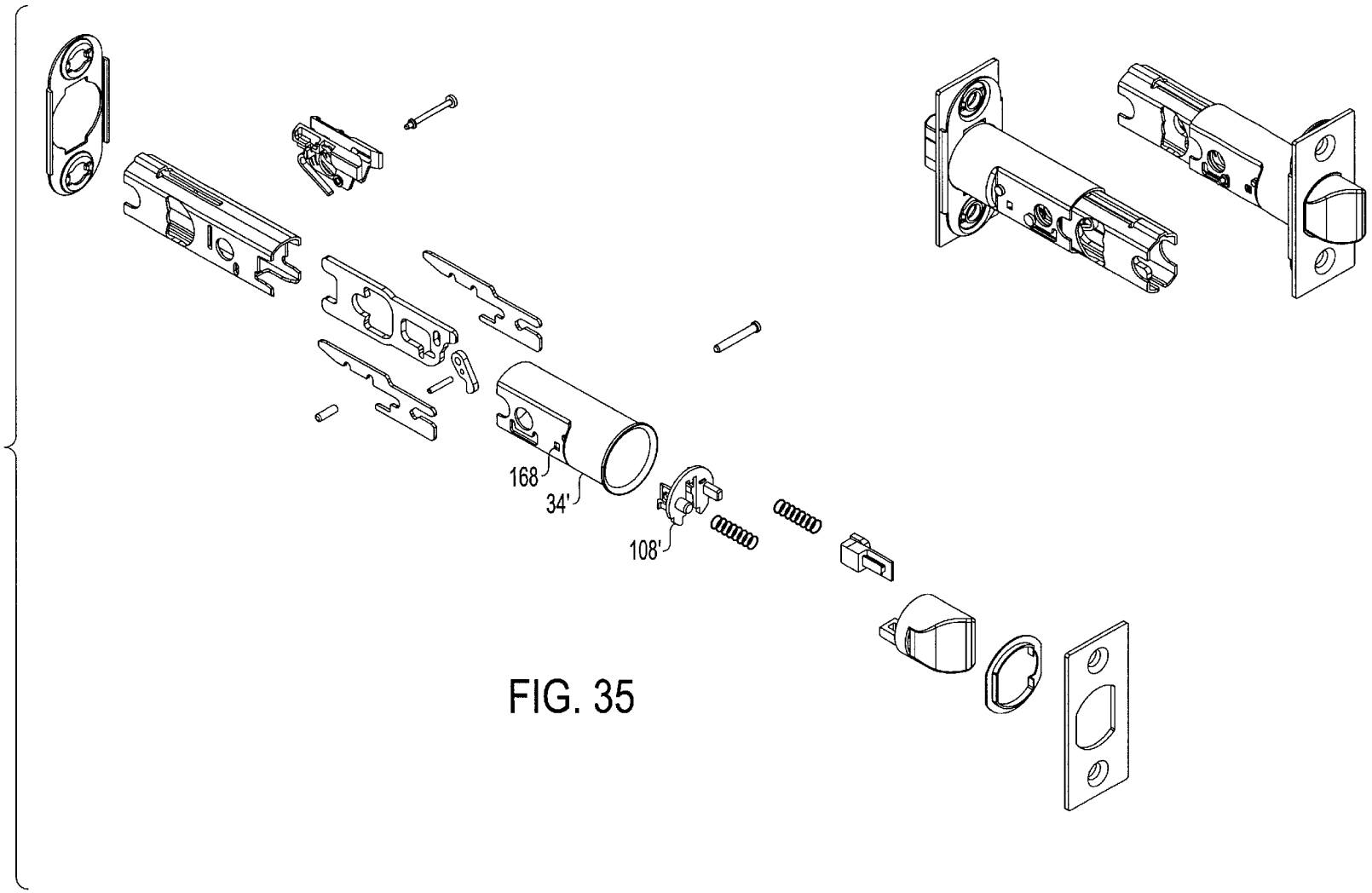
FIG. 35 is an exploded perspective view of a third embodiment of the adjustable backset latch mechanism of the present invention, in which no dead latching dog is used in a plain latch configuration.
Figure 36:
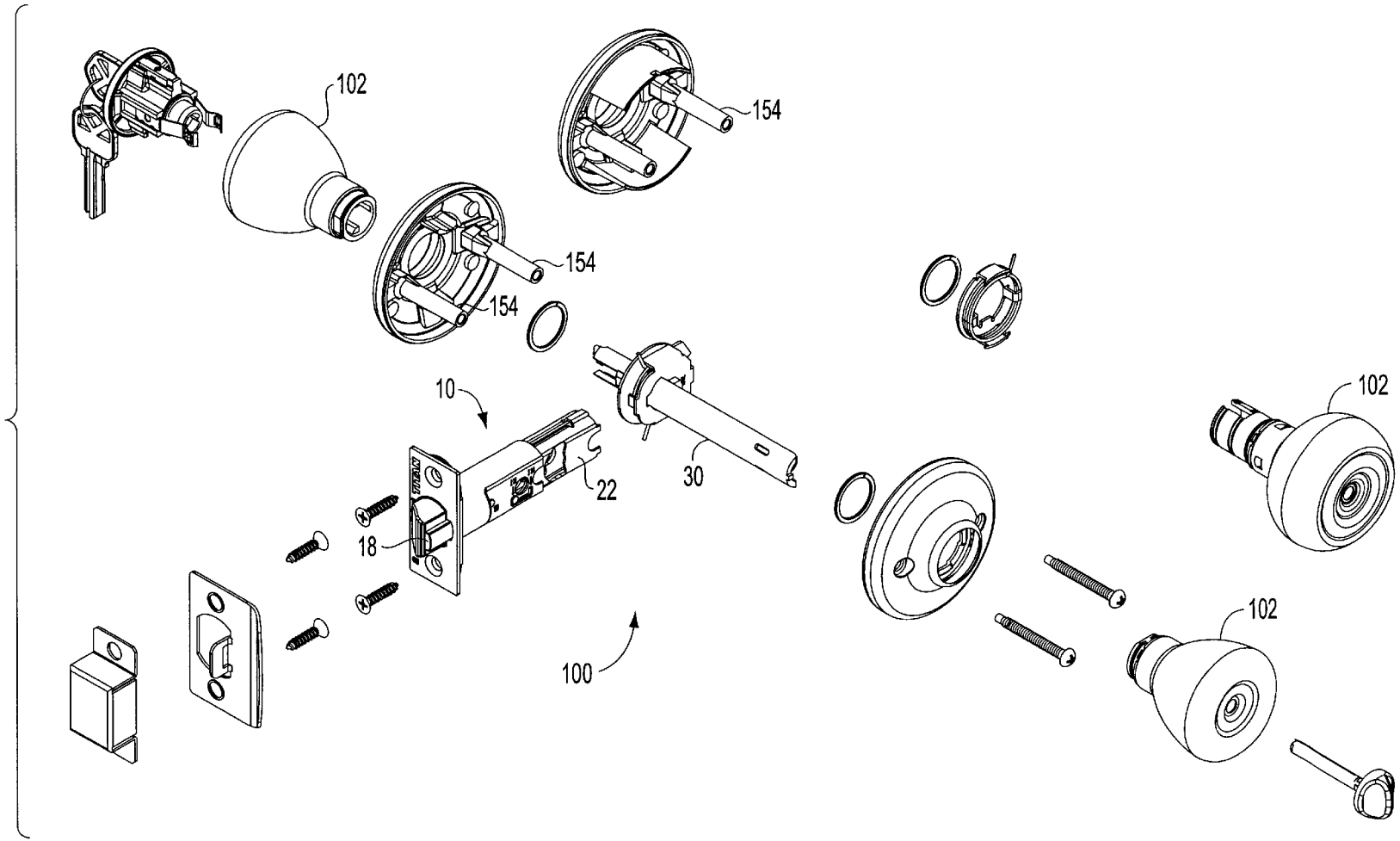
FIG. 36 is an exploded view of a lockset of the present invention incorporating the latch system of the present invention.

An adjustable-backset latch system for a lockset is shown in FIGS. 1, 2 and 35 generally as 10. With reference to FIG. 36, a lockset of the present invention incorporating the system 10 is referred to generally as 100. The adjustable backset latch system 10 of the present invention includes a bolt retraction system 12, a backset adjustment system 14 and a deadlatching system 16. For ease of introduction into this technology, those subsystems 12, 14 and 16 have been identified generally with brackets. Referring now to FIGS. 1 and 2, the bolt retraction system 12 of the present invention includes a main bolt 18 and an auxiliary bolt 20 which is withdrawn and pulled by bolt actuator 22. Bolt actuator 22 includes a left and right front link (24, 26) sandwiched together and connected to a back link 28. The back link in turn is driven along surface 29 by bolt operator 30, which, in a preferred embodiment, is a conventional half-round spindle or half-round, for short. Inasmuch as, in a preferred embodiment of the present invention, the bolt retraction system is a pull-type, in which movement of the elements 18, 22 and 30 are all in the retracting or rearward direction. This means that the action of the bolt operator 30 and the bolt actuator 22 are in the same direction of movement as the main bolt 18. Inasmuch as half-round 30 is semi-circular, rotation of the half-round against the back link inner surface 29 to retract the bolt actuator 22 is in a linear relationship, in that for every angular increment of movement of the half round there is a fixed incremental linear axial movement of the bolt actuator 22. At this point it should be noted that although components of the backset adjustment system 14 and the deadlatching system 16 are also shown in FIGS. 1 through 5, for ease of discussion, only the ones pertaining to the bolt retraction system 12 will be discussed at this point.

Figure 3:
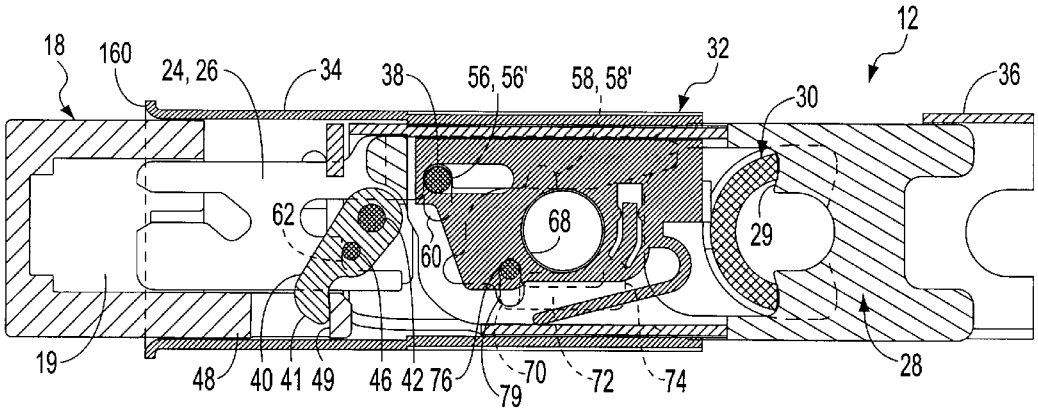
FIGS. 3, 4 and 5 are sequential sectional detail views of the bolt retraction system of the latch mechanism of the present invention, with FIG. 3 showing the bolt fully extended, FIG. 4 showing the bolt half-way retracted and FIG. 5 showing the bolt fully retracted, the bolt actuator being formed by the back link connected to the front link(s)
Figure 4:
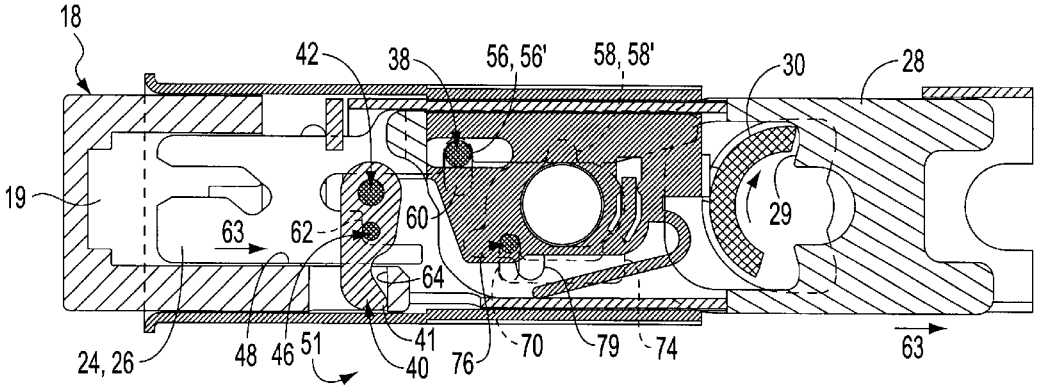
Figure 5:
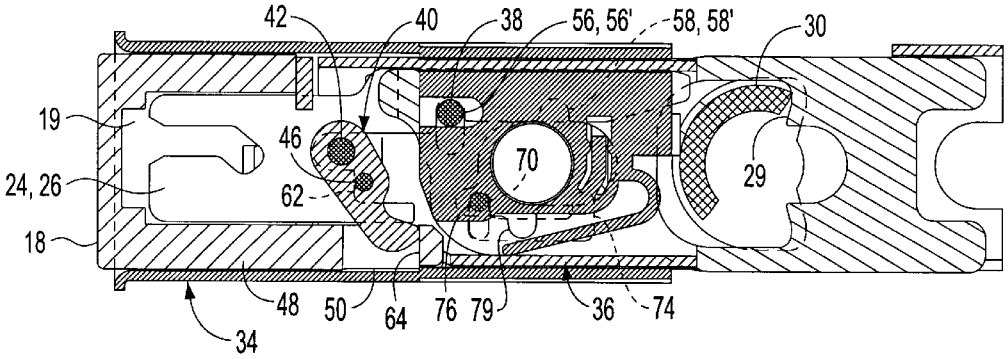

The front links 24, 26 and the back link 28 are slideably mounted in a housing 32 (FIG. 3) which is formed by an outer case 34 telescopically receiving an inner case 36, both preferably made of steel. As shown in FIGS. 3, 4 and 5, the bolt 18 is slideably mounted in the case 34 while the sandwich of front links 24, 26 and back link 28 are slideably mounted in inner case 36. The front links 24, 26 are also mounted so as to be slideably received in a cavity 19 defined by main bolt 18. Main bolt 18, as shown in FIGS. 3–5, is slideably received within outer case 34. As shown in FIGS. 1 through 5, an upper detent pin 38 connects left and right front links 24, 26 to the back link 28, such that rotation of half-round in the clockwise direction shown in FIGS. 3 through 5 retracts back link 28 and front links 24, 26 simultaneously. A cam 40 defining a bolt-engaging portion 41 is pivotally mounted by a pivot pin 42 to holes 44 in the outer case 34. A cam pin 46 is mounted on the cam 40 so as to be located wholly within the housing 32. The cam 40 is pivotally connected to the outer case 34 to engage main bolt 18 and a bolt slot 50 formed on a rearwardly-extending portion 48 of the main bolt, such that the bolt-engaging portion 41 of cam 40 engages a bolt slot interior surface 49 of the bolt rearwardly-extending portion 48. As will be described shortly, when the bolt actuator 22 is retracted, the cam 40 will be pivoted counterclockwise about pivot pin 42 as shown by the arrow 51 of FIG. 4. As can be seen in FIGS. 3, 4 and 5, the rotation of cam 40 will retract main bolt 18 from an extended position as shown in FIG. 3 to a retracted position as shown in FIG. 5. Referring now to FIG. 1, springs 52 and 54 between main bolt 18 and housing 32 (outer and inner cases 34, 36) normally bias the main bolt 18 to its extended position shown in FIG. 3, so that if the turning force on half-round 30 is released (such as by release of the lever or knob shown in FIG. 36), the springs 52, 54 will return the bolt 18 from its retracted position shown in FIG. 5 to its extended position shown in FIG. 3.

Now with reference primarily to FIGS. 1 and 2 and also to FIGS. 3, 4 and 5, a detailed description of the linkage connecting bolt operator 30 to bolt 18 will now be given. The front links 24, 26 are connected to back link 28 by upper detent pin 38 which rides in first downwardly-opening slots 56, 56' or 58, 58' and is carried by closed vertical slot 60 formed in back link 28. The axial distance separating the downwardly opening slots 56, 56' and 58, 58' is the desired backset increment, which in a preferred embodiment, is ⅜". The front links 24, 26 define respective rearwardly-facing cam pin-engaging surfaces 62 which, as shown in FIGS. 3 through 5, bear against cam pin 46, such that when bolt operator 30 is rotated clockwise as shown in FIGS. 3 through 5, the respective cam pin-engaging surfaces 62 formed on the spaced-apart in front links 24, 26 moves the cam pin 46 rearwardly as shown by arrow 63 in FIG. 4. Inasmuch as pivot pin 42 is fixed relative to the outer case 34, the bolt-engaging portion 41 of cam 40 must move rearwardly as well, as shown in FIGS. 4 and 5. The action is similar to the spaced-apart tines of a rake pulling a long twig rearwardly as someone pulls the rake handle rearwardly. In this case the "twig" is cam pin 46.

Figure 3A:
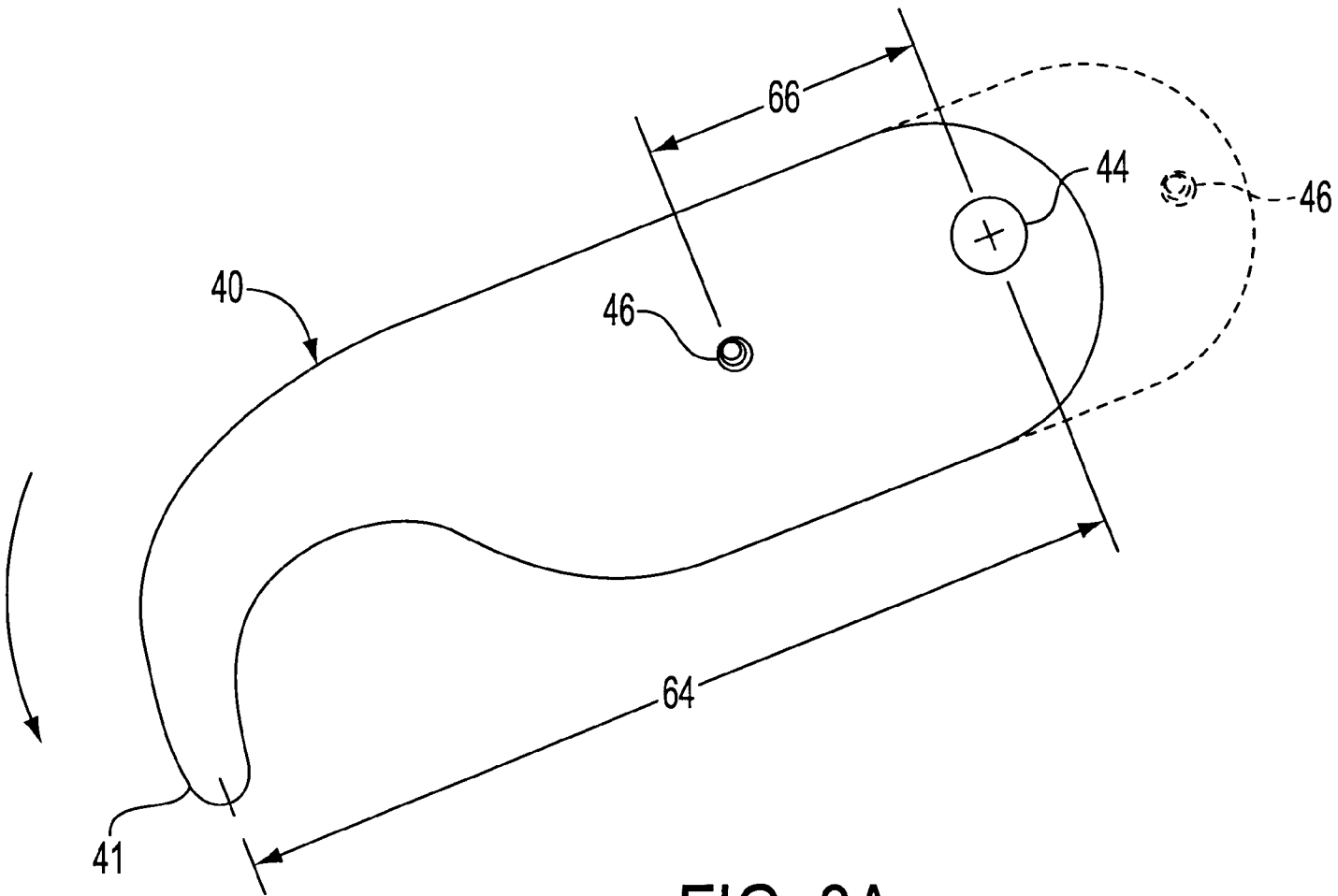
FIG. 3A is an enlarged schematic detail view of the cam of the present invention shown in FIG. 3.

Still with reference to FIGS. 3 through 5, but with particular reference to FIG. 3A, the distance-multiplying feature of the bolt retraction system of the present invention will be described. As can be seen in FIGS. 3 through 5, rotation of the half-round or bolt operator 30 takes place through a relatively short angular distance. One of the problems solved by the present invention is how to convert that relatively short angular distance to the much longer linear distance that the bolt 18 must travel from its extended position shown in FIG. 3 to its retracted position shown in FIG. 5. In a preferred embodiment, the distance from the bolt-engaging portion 41 of the cam 40 to the location of the pivot pin 44, designated 64 in FIG. 3A, and the distance 66 between the cam pin 46 and the pivot pin 44 are selected to have a relationship equal to the desired multiplier for multiplying the angular distance traveled by the bolt operator 30 to achieve the desired retraction distance of the main bolt 18. In a preferred embodiment of the present invention that multiplier is about 2.5. Another feature by which this multiplication is obtained is by locating both the bolt-engaging portion 41 on the same side of the pivot pin 44 as the cam pin 46, in other words, rather than having the cam pin 46 located above the pivot pin 44 as shown in phantom in FIG. 3A.

To summarize, when a person turns a handle or a knob of the lockset 100, the force is transmitted through a bolt operator or half-round 30 which, when it rotates, pulls a linkage formed by front links 24, 26 and back link 28 to thereby pivot a cam about fixed pivot pin 42. This in turn pulls main bolt 18 from an extended position to a retracted position against the bias of springs 52, 54. The backset adjustment system of the present invention will now be described.

In any backset adjustment system, it is crucial that the bolt retraction action and the length of the bolt travel, not be affected by the act of changing the backset. In all but the most primitive of backset adjustment systems, the trick is how to get the housing in which the bolt is retracted and extended, and the linkage connecting the bolt to the bolt operator, to accommodate the changes in backset. Another challenge is to make the backset adjustment in as few motions as possible. This means the user can save time and does not have to adjust the backset through trial and error. Ideally, the housing length adjustment and the bolt or bolt actuator length adjustment are done simultaneously. That certainly saves time and reduces the risk that the adjustment is not going to be made consistently. Another is to minimize the number of parts, and to avoid, if at all possible, developing a system that has loose parts accessible by the user. Ideally, the system would be actuatable with one hand. One well-known backset adjustment system comes close. This simply requires that the user rotate one housing member relative to another and a spiral groove and pin arrangement causes the housing members and the bolt or bolt extension members to move simultaneously by the desired backset increment. No adjustments need be made by the operator. However, this system can be improved to eliminate the rotation element, to reduce the number of parts in the backset adjustment system and to make it actuatable by a person using just one hand. That is precisely what the backset adjustment system of the present invention accomplishes. At this point, reference should be made to FIGS. 1 and 2, FIG. 6, and FIGS. 10 through 19, the latter set of figures showing a step-by-step progression and position of the backset adjustment elements during the process for changing the backset by a predetermined backset increment. It was previously noted (refer to FIG. 1) that the backset distance of the bolt actuator 22 (front and back links 24, 26 and 28) can be changed by moving the upper detent pin 38 in either set of slots 56, 56' or 58, 58' located in the front link sandwich. So this is the basic way to change the distance of the bolt actuation system without affecting the travel of the bolt. How to adjust the length of the housing 32 is another question. And still another question is how to coordinate the adjustment of the housing and the bolt actuator lengths simultaneously and positively. Solutions to these two problems will now be described.

Lower detent pin 76 rides in the "U"-shaped slot 68 which is formed on both sides of the outer case 34 and, during the process for changing backset, the central part of that lower detent pin 76 also engages an upwardly-extending slot 79 in the back link 28. "U"-shaped slot 68 is defined by two parallel vertical slot portions 70, 74 separated by a horizontal slot portion 72. As will be seen momentarily, that is how the user can shift the back link 28 rearwardly when engaging the graspable portions 78 of the lower detent pin and moving it along the horizontal slot portion 72. Now with reference to inner case 36 (see FIG. 1 in particular), there is a short vertical slot 80, formed on both sides of inner case 36. This receives lower detent pin 76 so that when the user grasps the ends 78 of lower detent pin 76, and moves the detent pin along "U"-shaped slot 68, that motion will carry inner case 36 rearwardly by the amount of travel of the lower detent pin 76. And inasmuch as the horizontal slot portion 72 has a length equal to the desired backset increment, as the user moves lower detent pin along the horizontal slot portion 72, the lower case 36 (via slot 80) is moved exactly the desired backset increment.

To recap, only two pins are used in the backset adjustment process: Upper detent pin 38 (which is not visible to the user) connects the front and back links via slots 56, 56' and 58, 58', and 60, such that when the upper detent pin 38 is moved from the front or first set of downwardly opening slots to the second or rear set of downwardly opening slots, the length of the bolt actuation system 12 is changed by the desired backset increment. On the other hand, when the other pin (lower detent pin 76) is moved from the first or front vertical slot portion 70 along the horizontal slot portion 72 to a second or rear vertical slot portion 74, that motion carries the inner case 36 rearwardly via slot 80 by exactly the same backset increment. Now the system of the present invention for coordinating the motions and timing of various elements of the backset adjustment system will be described.

Figure 6:
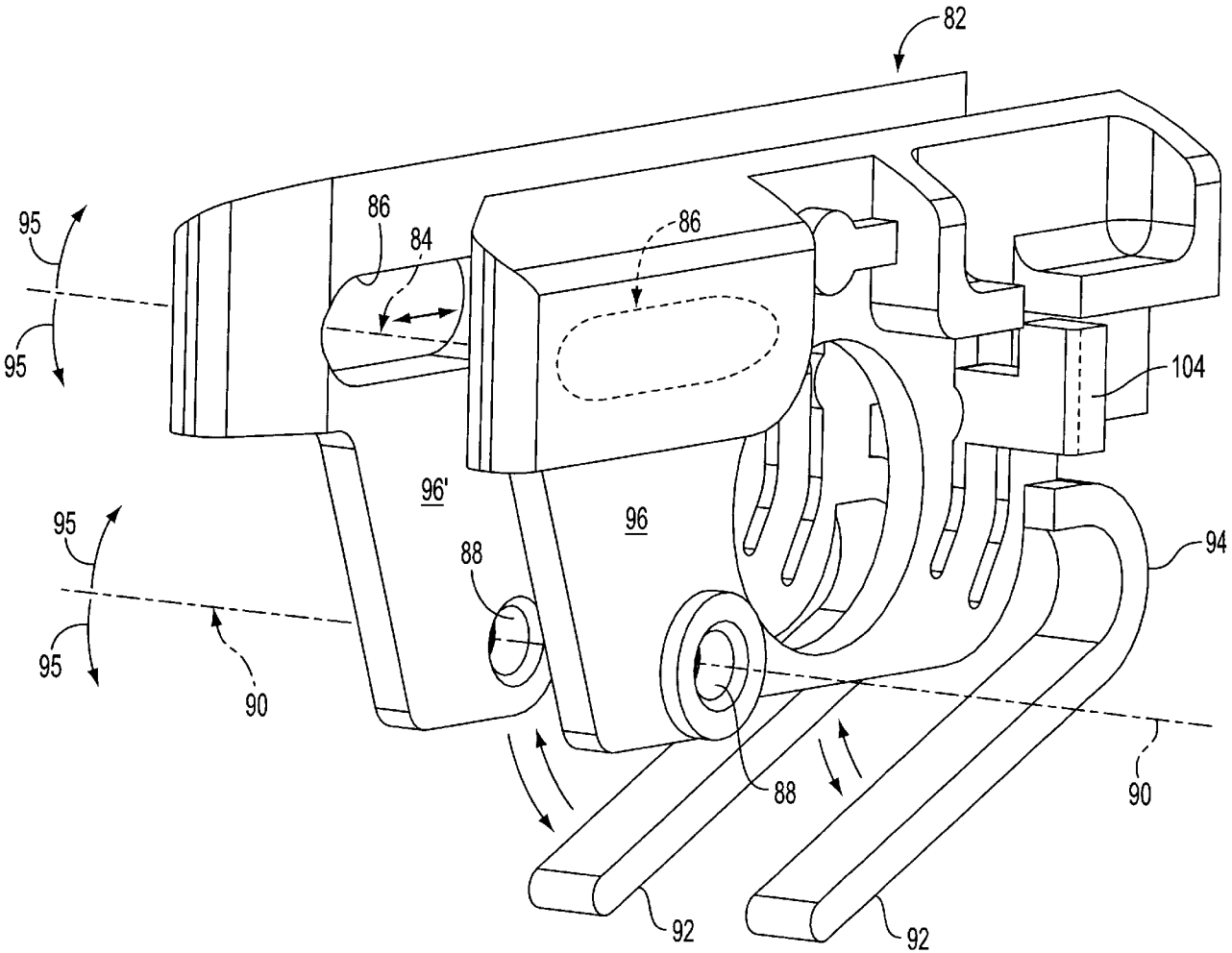
FIG. 6 is an enlarged perspective detail view of the adjuster of the present invention.
Figure 25:
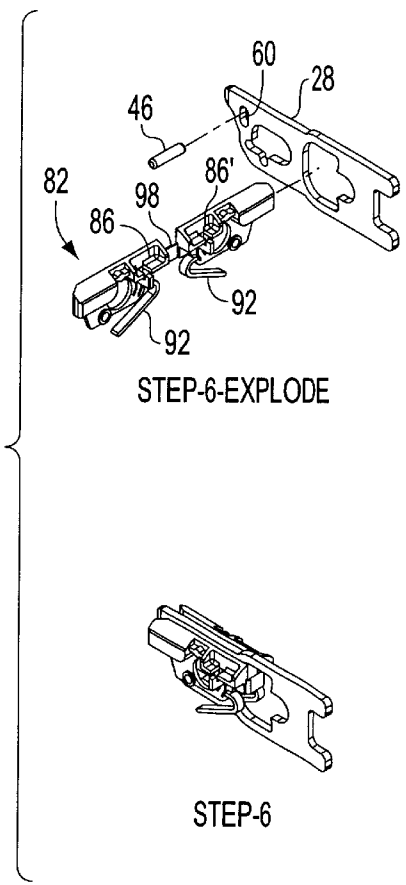
Figure 24:
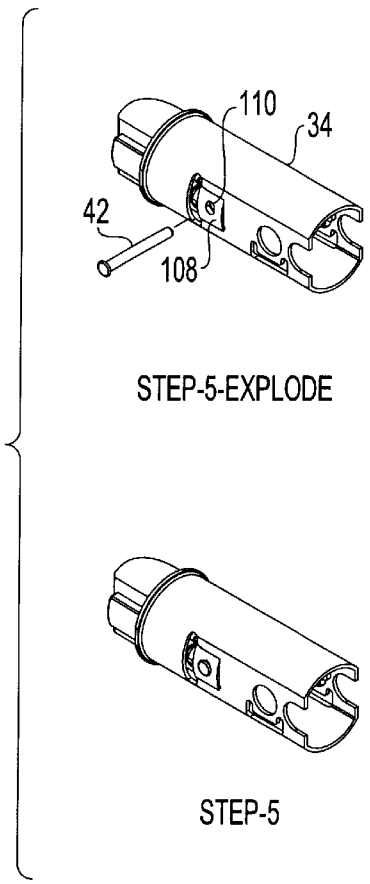
Figure 23:
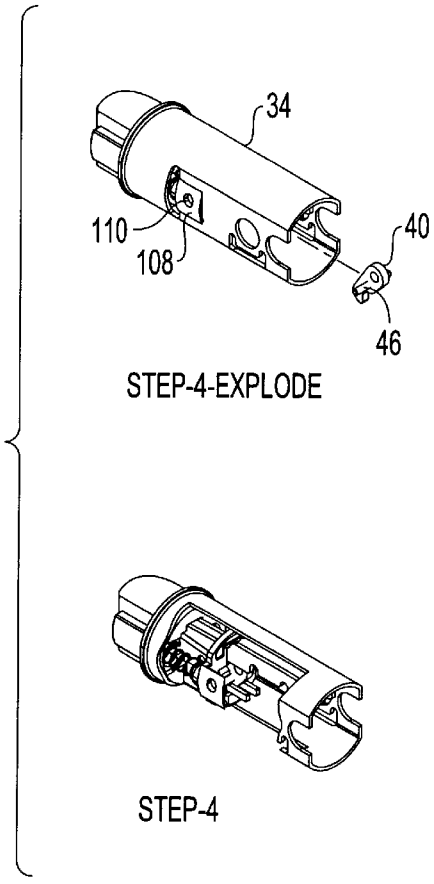

Referring to FIGS. 1 and 2 and especially to FIGS. 6 and 10 through 19, the heart of the adjustment system, namely adjuster 82, can be seen. The adjuster 82 is shown as a shaded element in FIGS. 10 through 19, and is shown in detail in the enlarged perspective figure in FIG. 6. Both the upper and lower detent pins 38, 76 are located in and controlled by adjuster 82. Now with particular reference to FIG. 6, the upper detent pin 38, whose centerline is shown schematically in FIG. 6 as 84, moves in channel 86 formed on both sides of adjuster 82. Lower detent pin 76, on the other hand, is held from longitudinal movement in holes 88. The centerline for lower detent pin 76 is designated as 90. Consequently, when the user grasps the ends 78 of lower detent pin 76 to move it along the horizontal portion 72 of "U"-shaped slot 68 in the outer case 34, the entire adjuster 82 is moved rearwardly (with inner case 36). However, upper detent pin 38 must be allowed to move relative to adjuster 82, inasmuch as that pin 38 must be free to travel back and forth with the sandwich of the front links 24, 26 and the back link 28 when the main bolt 18 is retracted by the bolt operator 30. Thus, channel 84 provides a clearance for an element of the bolt retraction system (upper detent pin 38) to move as the bolt operator rotates, either retracting the main bolt 18 or allowing it to extend as biased by springs 52 and 54. With further reference to FIGS. 1 and 6, the adjuster 82 further defines two resilient feet 92 joined by a curved portion 94 to the body of the adjuster 82. The purpose of these feet is to normally bias the adjuster upwardly in a "locked" position; this being the normal state of the adjuster when the backset has been adjusted and the user is now ready operate the latch. For this purpose, in a preferred embodiment, the adjuster is a single-piece of plastic, for example DELRIN/acetal plastic or its equivalent, that provides both good lubricity, strength and resilience. Thus the adjuster 82 may be moved up and down as indicated by arrows 95 responsive to either actuation by the user grasping the lower detent pin to push the adjuster downwardly via holes 88 or by releasing the lower detent pin 76, allowing the resilient feet 92 to bias the adjuster 86 to return to its "locked" position shown in FIG. 6. Adjuster 82 is, in a preferred embodiment, formed as two halves 96 and 96' joined at the rear or inward end by living hinge 98. A view of the adjuster in its unfolded state is seen in the top of FIG. 25. With the adjuster folded as shown in FIG. 1, it is now able to accept in the space between its two halves the sandwich made up of front links 24 and 26 and back link 28.

To summarize, the adjuster 82 is fixed axially relative to inner case 36 by lower detent pin 76 and slot 80. Thus as the user moves the lower detent pin 76 to adjust the backset by the desired backset increment, the adjuster moves rearwardly with the inner case 36. Referring once again to FIGS. 1 and 6, if desired, a stabilizing tab 104 formed on both sides of the adjuster can be used to stabilize the vertical movement of the adjuster in inner case 36 via vertical slot 106.

Figure 10:
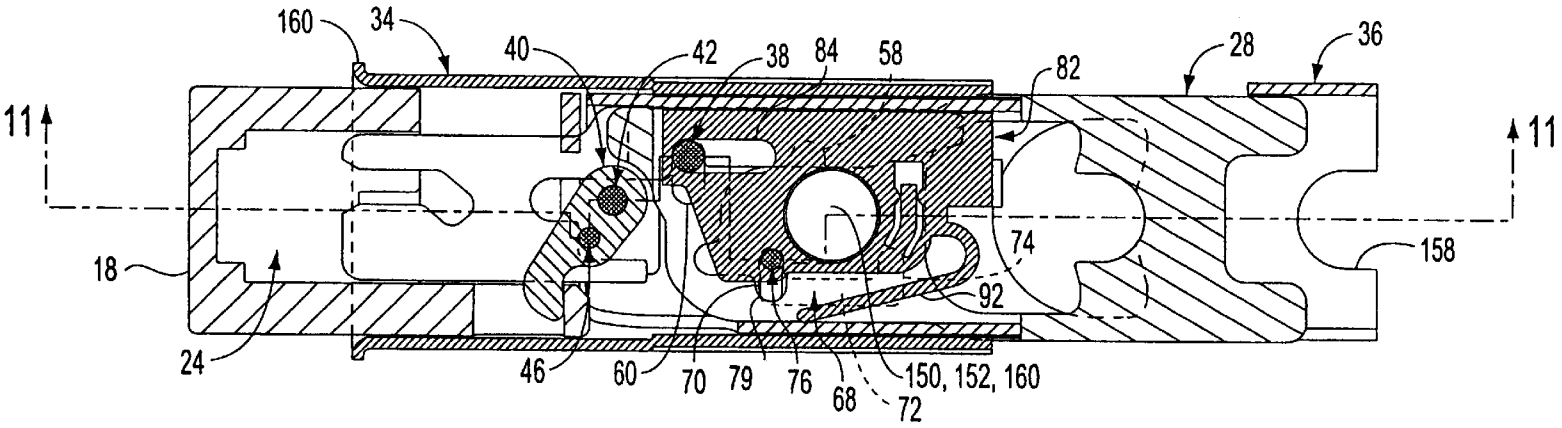
FIGS. 10 through 19 are step-by-step Figures showing the sequence of operation of a backset adjusting system of the present invention.
Figure 11:
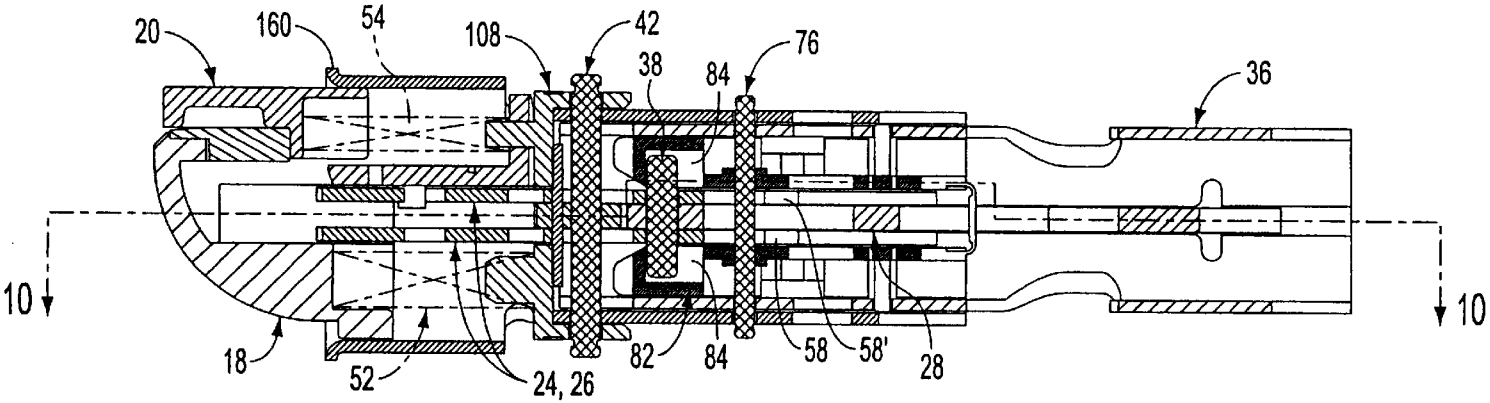
Figure 12:
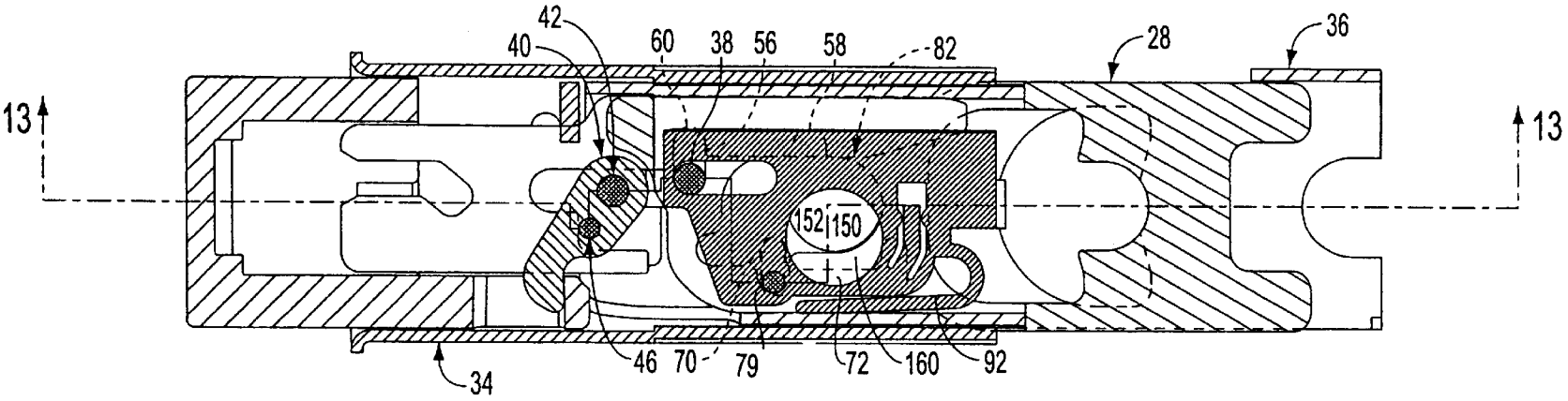
Figure 13:
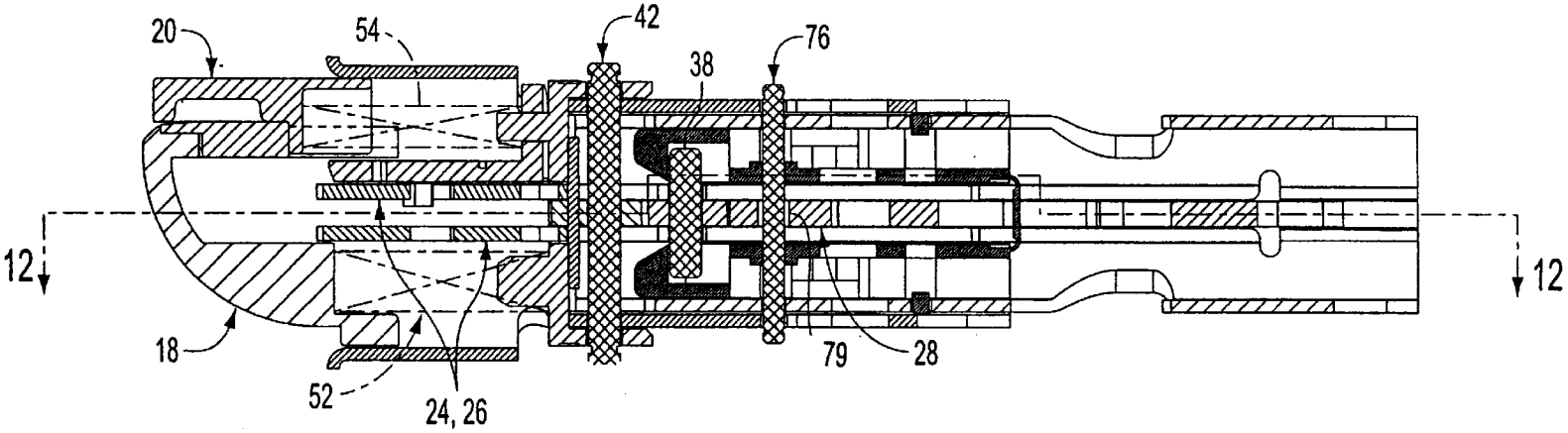

The operation of the adjuster in FIGS. 10 and 11 show the backset adjustment system in its first backset length, which, in a preferred embodiment is 2⅜". In this position the adjuster 82 is in its upwardmost or locked state in which the upper detent pin 38 rests in grooves 56, 56' of the front links 24, 26, respectively, and in which the lower detent pin 76 rests in a first or locking state at the top of the outermost vertical groove portion 70 of the "U"-shaped slot 68. This first locking state is maintained by the bias of flexible foot 92 extending from adjuster 82 and bearing against inner case 36. When the user grasps the ends 78 of lower detent pin 76 and moves the pin downwardly in vertical slot 70, the adjuster 82 is likewise pivoted downwardly against the bias of the spring foot 92. This is shown in FIGS. 12 and 13. The upper detent pin 38, having been captured against vertical movement relative to the adjuster 82, is consequently moved downwardly in slot 56 as shown in FIG. 12. The system is now ready for the user to adjust the backset by the desired backset increment which, in a preferred embodiment of the present invention, is moving from 2⅜" to 2¾", backset increment of ⅜".

Figure 14:
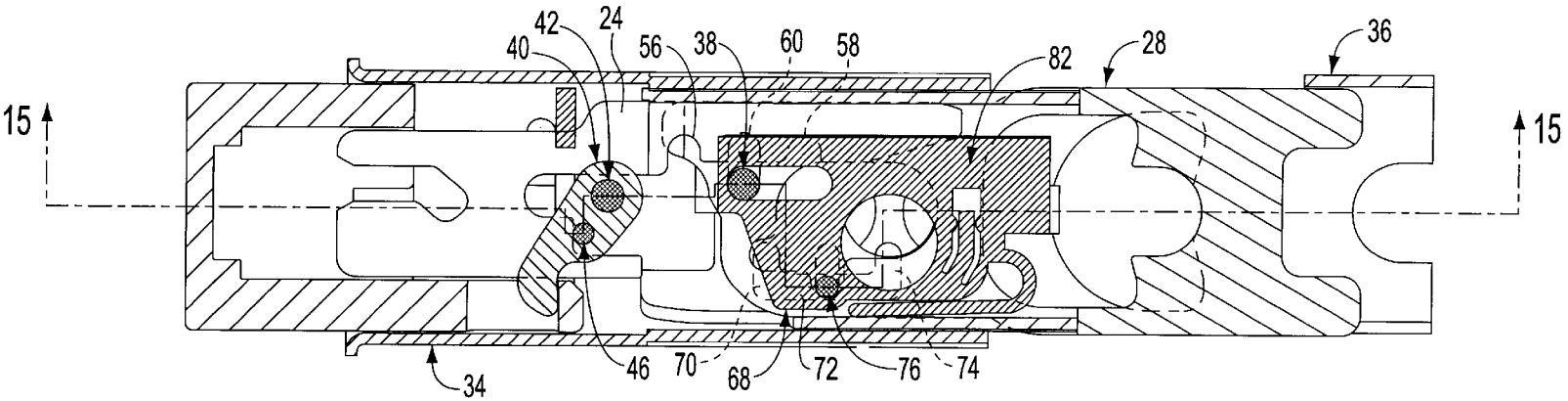
Figure 15:
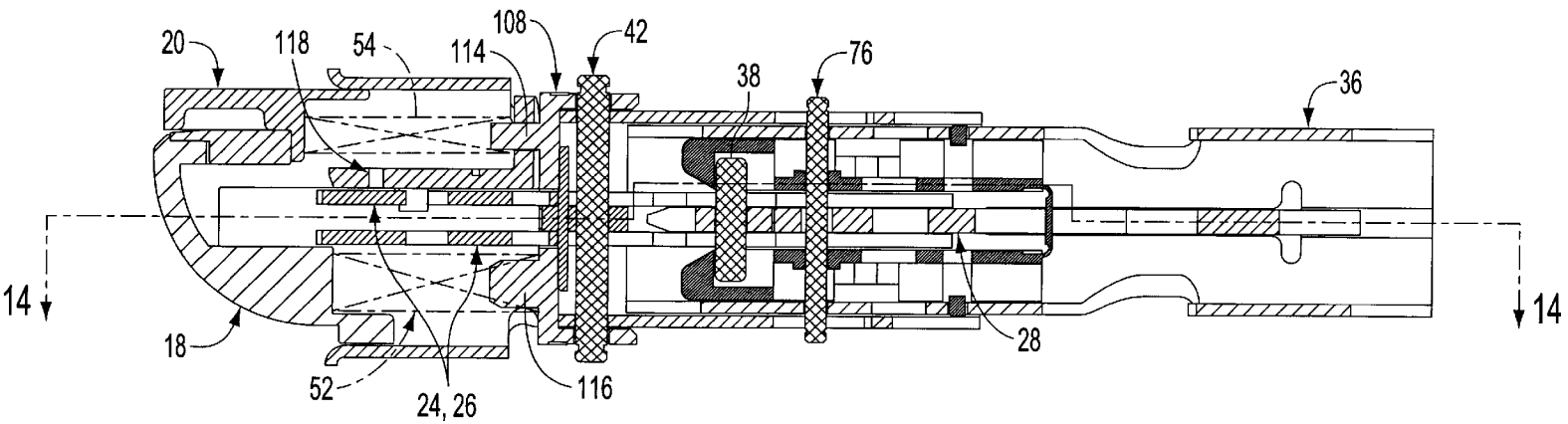
Figure 16:
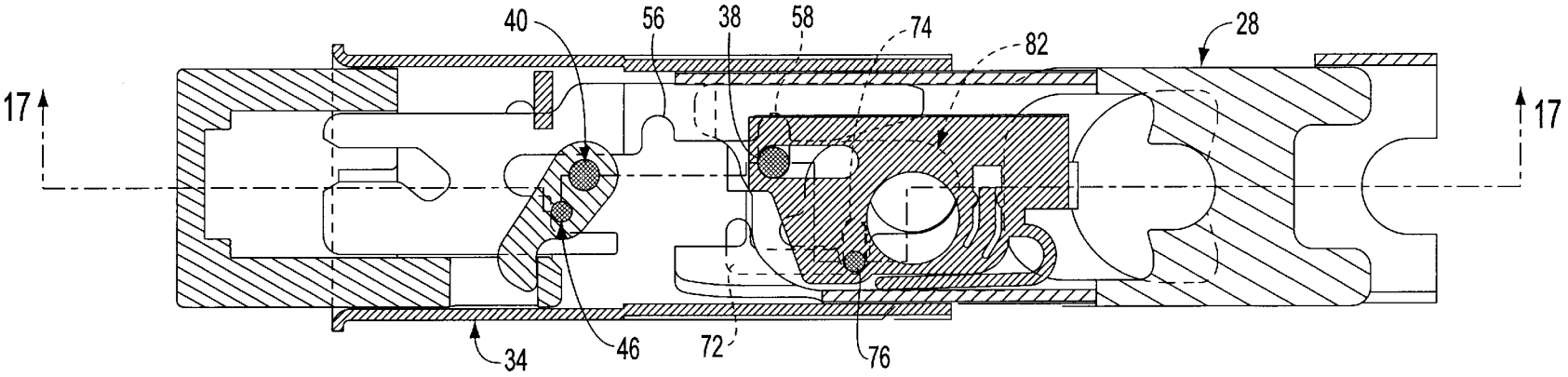
Figure 17:
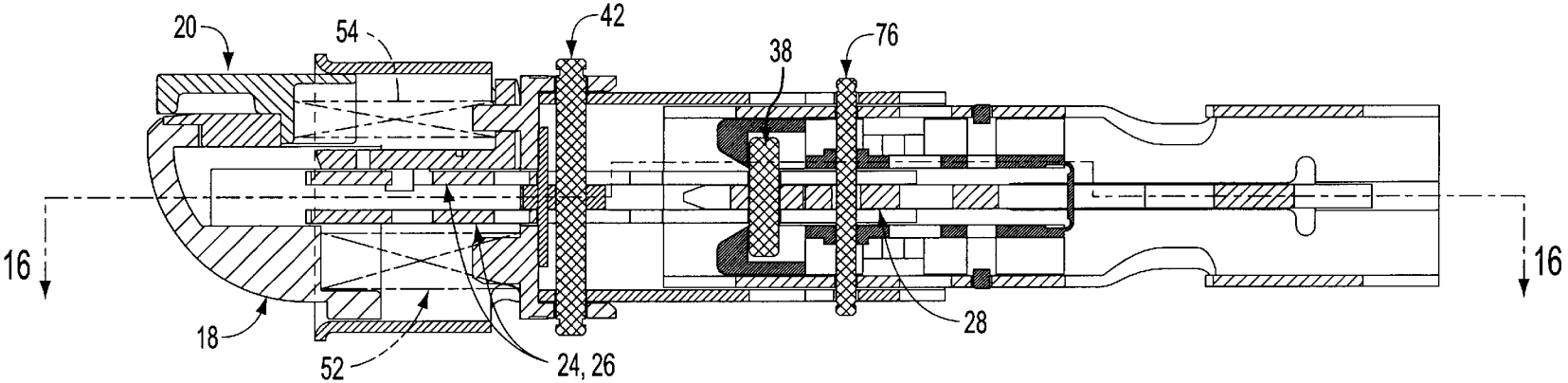

Now referring of FIGS. 14 and 15, the user has begun moving the lower detent pin 76 along the horizontal portion 72 of the "U"-shaped slot 68 in the outer case 34. Note that the upper detent pin 38 has now moved free of the first downwardly opening slot 56 in the front link 24 and has traveled midway between the first slot 56 and the second downwardly opening slot 58 as the lower detent pin 76 as reached its midway point in slot 72, between the vertical slots 70 and 74 of "U"-shaped slot 68. Pin 76, however, being engaged now with upwardly opening slot 78 of back link 28, draws back link 28 with it as it moves adjuster 82 rearwardly (see FIGS. 12 and 13). During this motion, namely from the stage shown in FIGS. 12 and 13 through the stage shown in FIGS. 14 and 15 and to the stage shown in FIGS. 16 and 17, the front and back links 24, 26 and 28 have been uncoupled. Moving now to FIGS. 16 and 17, the lower detent pin 76 has reached the rearwardmost extent of its travel along horizontal slot portion 72 and is now positioned at the bottom of the second or rear vertical slot portion 74 of "U"-shaped slot 68. Likewise upper detent pin 38 has been carried to a position just opposite downwardly opening slot 58, and back link 28 is now in an extended relationship with respect to front links 24 and 26, by the backset increment. Note that while this action has been taken place, lower detent pin 76, which is carried in slot 80 of inner case 36 has moved inner case 36 by exactly the same distance as has back link 28. This can be seen by comparing the relative positions of the cases 34 and 36 and the links 24, 26 and 28 in FIGS. 10 and 11 with their positions in FIGS. 16 and 17. Notice however that the position of back link with respect to inner case 36 has not changed from the stage shown in FIGS. 10 and 11 to that shown in FIGS. 16 and 17. Nor for that matter has the relative positions of the front links 24, 26, the outer case 34, and the bolt 18 changed nor has the relative positions of adjuster 82 to the inner case 36. As previously noted, this result is essential to providing a consistently-operating bolt retracting system regardless of what backset position the user has selected.

Figure 18:
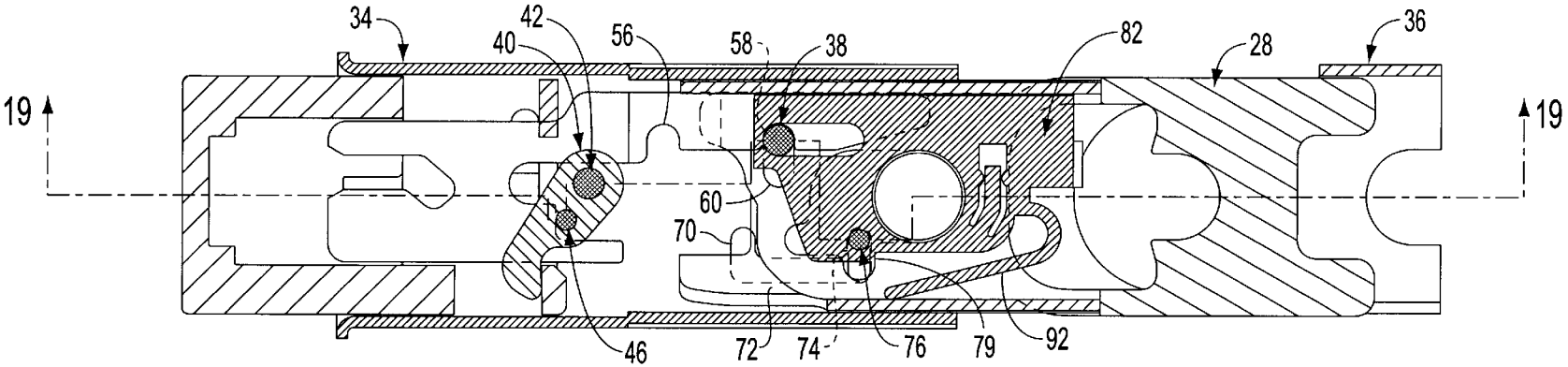
Figure 19:
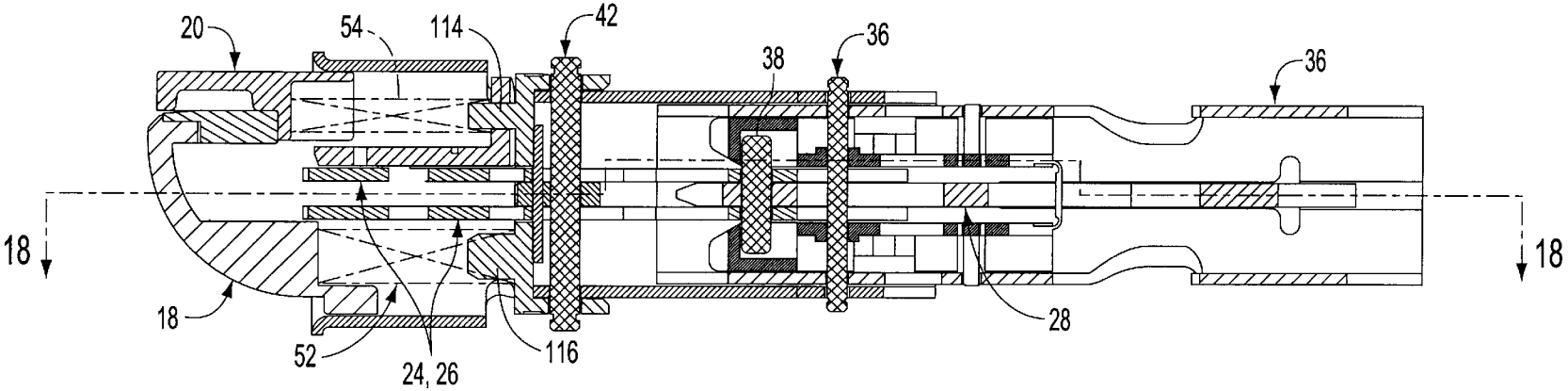
Figure 22:
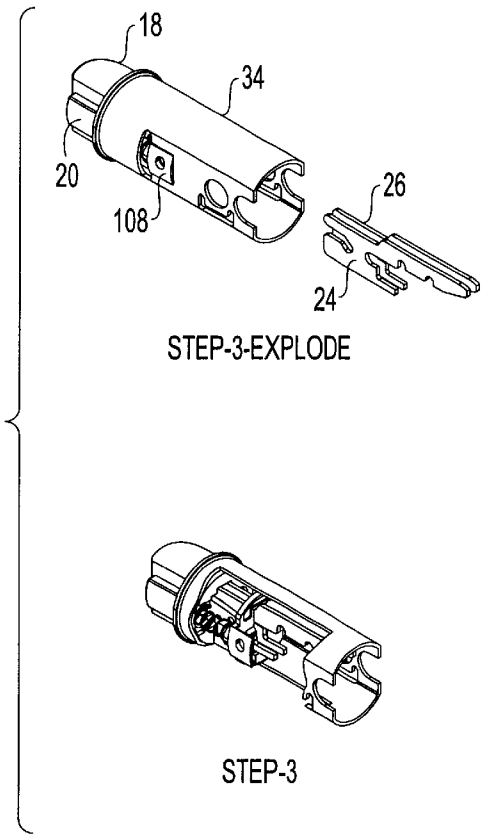
FIGS. 20 through 30 are sequential exploded perspective detail views of the sequence of assembly of the adjustable backset latch mechanism of the present invention.
Figure 21:
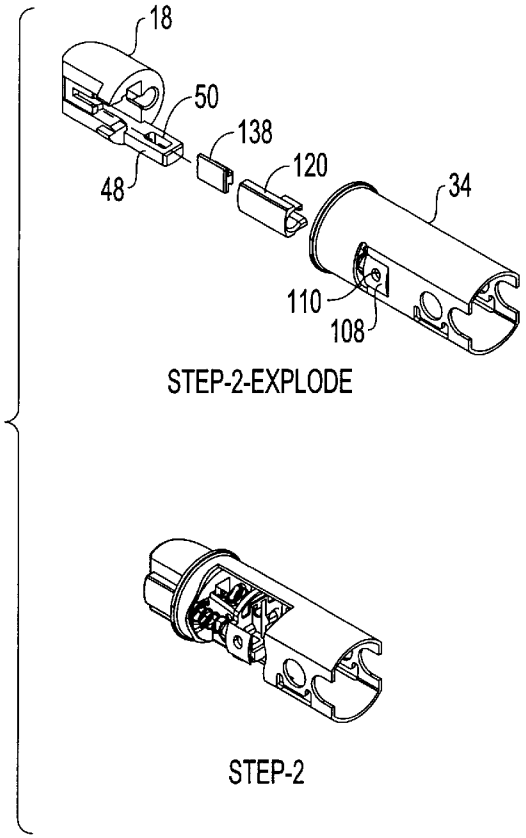
Figure 20:
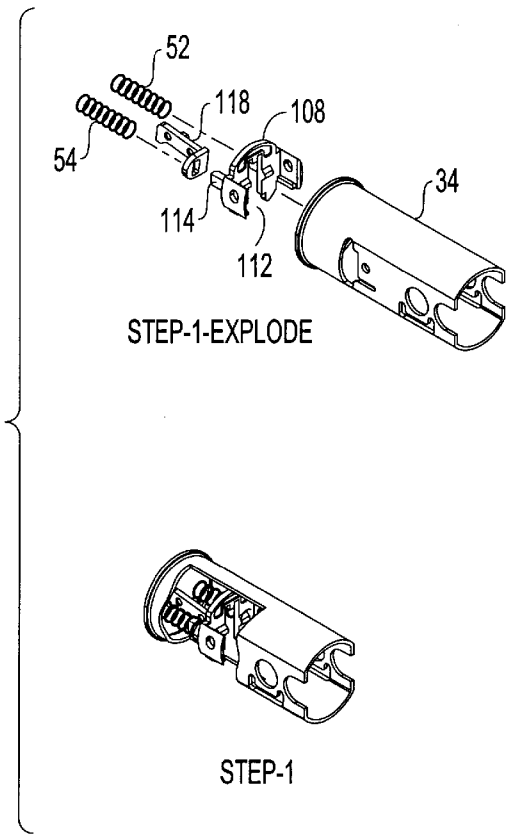

Now referring to FIGS. 18 and 19, the user allows the adjuster 82 to move to its third or rest state as shown in FIG. 18 by simply releasing the lower detent pin and allowing the bias of spring feet 92 to return adjuster 82 to a locked position. Here lower detent pin 76 is now at the apex of inward vertical slot portion 74 and cannot move axially, and upper detent pin 38 is now nested in rearward or downwardly opening slots 58, 58'. The bolt actuating system has now been locked into its backset adjusted position and actuation of the bolt operator 30 by the user will result in the usual retraction of bolt 18. The deadlatching system 16 of the present invention will now be described.

Figure 7:
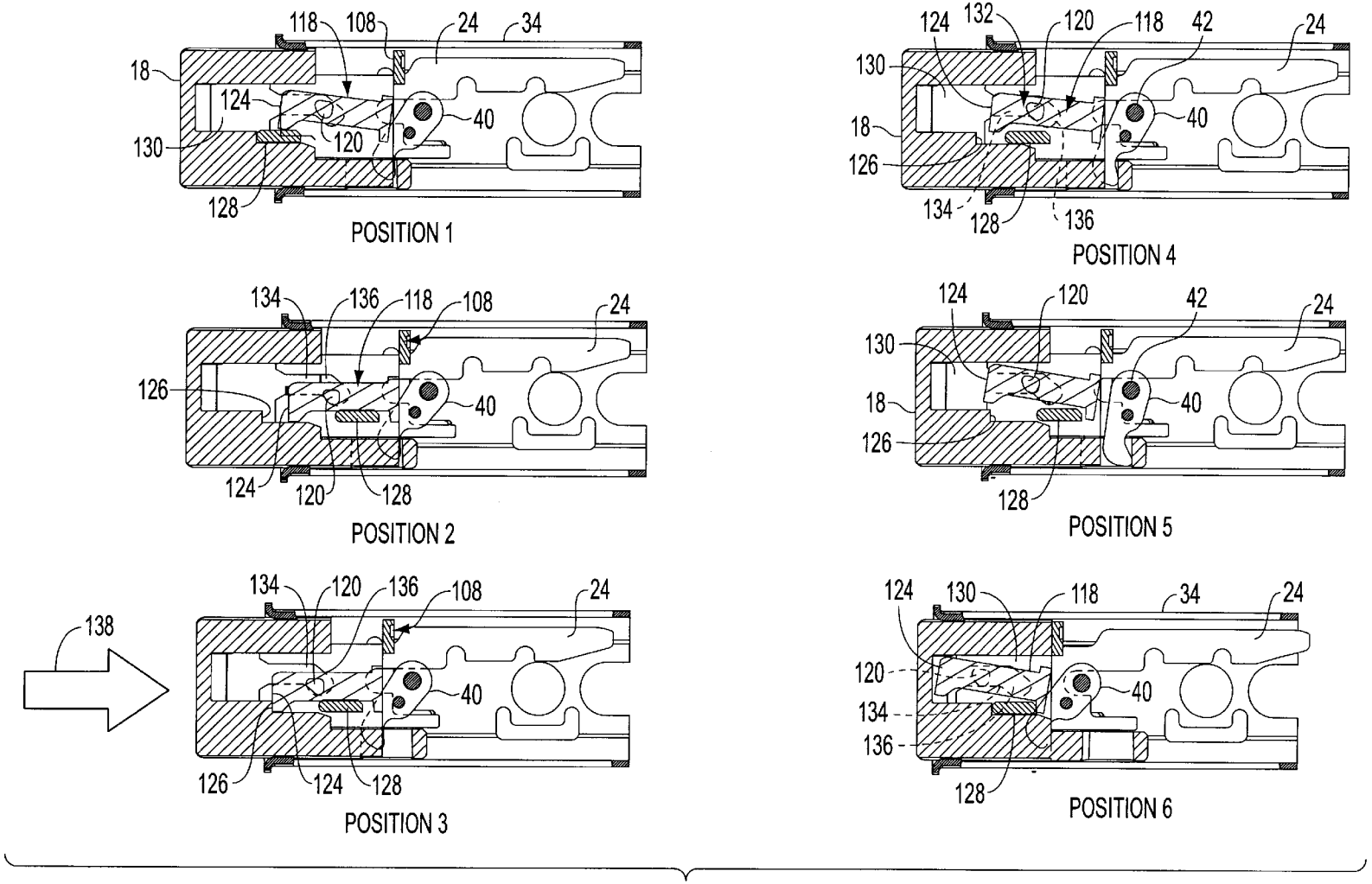
FIG. 7 is a series of sequential views showing the operation of the dead latching locking and releasing mechanism of the present invention.

With reference to FIG. 1 and with particular reference to FIG. 7 (in which fixed positions of the deadlatching system are shown), the elements of the deadlatching system are designed to prevent the main bolt 18 from being fully retracted if the auxiliary bolt has been retracted by the action of the bolt subassembly having encountered a door strike. The door strike will have an aperture that admits entry only of the main bolt 18 while maintaining the auxiliary bolt 20 in a retracted position. Various mechanisms exist which then block movement of the main bolt 18 beyond a certain distance into a housing. Now with reference to FIGS. 1 and 15 and with particular reference to the step-by-step positions of the deadlatching system shown in FIG. 7, a holder 108 is connected to outer case 34 such that pivot pin apertures 110 are in registration with pivot pin aperture 44 in the outer case. Pivot pin 42 will secure the holder 108, the cam 41 and the outer case 34 together. Holder 108 further defines vertical aperture 112 for receiving the front link sandwich, a protuberance or post 114 and a protuberance or post 116. Post 114 usually receives spring 54 and deadlocking dog 118 for pivotable movement about post 114. The deadlocking dog 118 defines a cam follower 120 on one side of the deadlocking dog that coacts with the front links 24, 26 as will be described shortly. The deadlocking dog 118 further defines a bolt-engaging or front portion 124 that, in the deadlatching position, engages a bolt blocking portion 126 formed on an interior surface of bolt 18. The front portion 124 is also engageable with shelf 128 formed on auxiliary bolt 20. As shown in FIG. 7, the front links 24, 26 can be received in cavity 130 formed inside the bolt when the bolt is fully retracted as shown in position 6 of FIG. 7. Cam follower 120 coacts with a front link cam groove 132, which is defined by a substantially axial portion 134 and an angled portion 136. With particular reference now to FIGS. 1 and 15, a first spring 52 is mounted over post 116 while second spring 54 is mounted between deadlocking dog 118 and auxiliary bolt 20 in such a way as to normally bias auxiliary bolt 20 to its extended position, and further normally biasing the loosely-mounted deadlocking dog 118 in a direction to pivot downwardly so that the front or bolt-engaging portion 124 engages a blocking shelf 126 formed on an interior surface of bolt 18.

In operation, as shown in FIG. 7, the action of the deadlatching system 16 of the present invention in the deadlatching is shown in positions 1, 2 and 3, while the action of system 16 after retraction of front links 24 and 26 by the user is shown in positions 4, 5 and 6. In positions 1 through 3, as the bolt 18 and auxiliary bolt 20 are swung into place to engage the strike and door strike receptacle in the door frame, the auxiliary bolt 20 (and consequently the auxiliary bolt shelf 128) is moved rearwardly (see the change from position 1 to position 2). This allows the front portion 124 of deadlocking dog 118 to drop or pivot downwardly under the bias of spring 54. Thus, if an intruder tries to move the main bolt 18 into its retracted position using, for example, a credit card as shown by the arrow 138, the front portion 124 of the deadlocking dog 118 blocks further rearward movement of the bolt 18 by its engagement with the blocking portion 126 formed in the bolt. Now with reference to positions 4 through 6, if the user rotates the knob or lever 102 (FIG. 36) to retract the bolt 18, as previously described, rotation of the knob or lever retracts front links 24, 26. Not only does this cause cam 40 to pivot counterclockwise about pivot pin 42, but moving the front links 24, 26 also moves the cam groove 132. Beginning with the angled portion 136 in the cam groove 132, the cam follower 120 formed on the deadlocking dog is moved upwardly (see position 5) such that front portion 124 of the deadlocking dog is raised above an interfering relationship with the bolt blocking portion 126. Thus, as the bolt is further retracted as shown in position 6 of FIG. 7, the substantially axial portion 134 of the cam groove 132 permits the deadlocking dog 118 to travel axially into the bolt clearance cavity 130 as shown in position 6. Note that the arrangements of the various elements of the deadlatching system 16 of the present invention bides the timing of the various elements. Note, for example, in position 5 of FIG. 7, the deadlocking dog 118 is lifted completely before the bolt 18 arrives there and that shelf 128 of auxiliary bolt 20 has been returned as shown in position 6 to its original position against the bolt blocking portion 126 (see also position 1). Thus, with a minimum of parts, and using, for example a spring to accomplish multiple purposes, an effective, reliable deadlatching system has been achieved. Additional features of the adjustable backset latch system 10 of the present invention will now be discussed.

Figure 8:
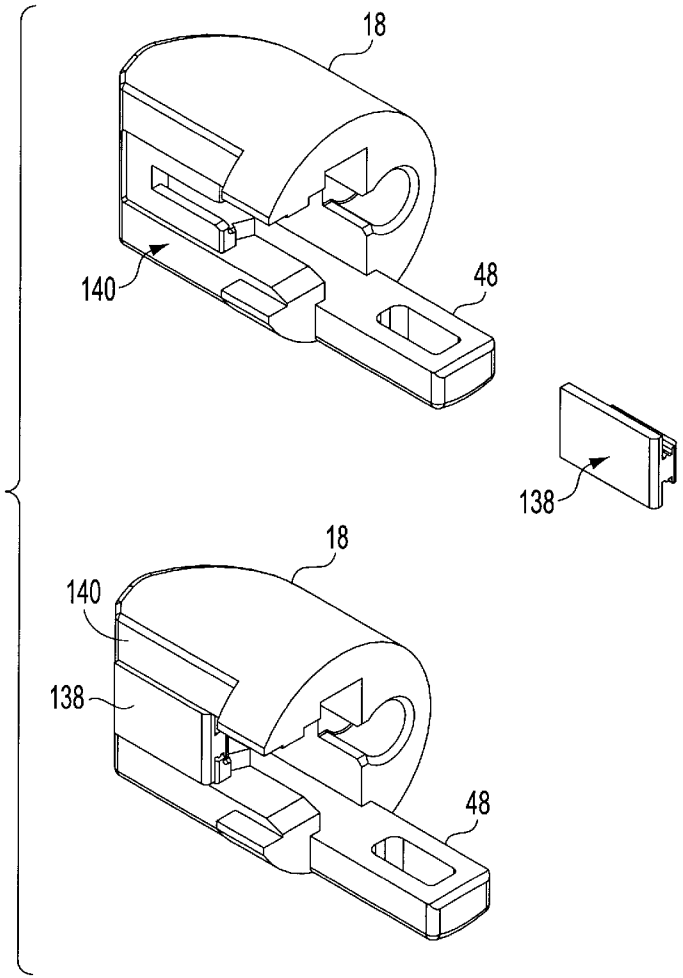
FIG. 8 is a set of enlarged perspective detail views showing the use of a low-friction insert in the bolt subassembly.

With reference to FIG. 8, a low-friction plastic bolt insert 138 is inserted into the main bolt 18 such that its surface is flush with the flat surface 140 of the bolt. This will reduce friction between the bolt 18 and the strike plate located in the doorframe. The insert 138 is press-fit into place into the main bolt 18.

Figure 9:
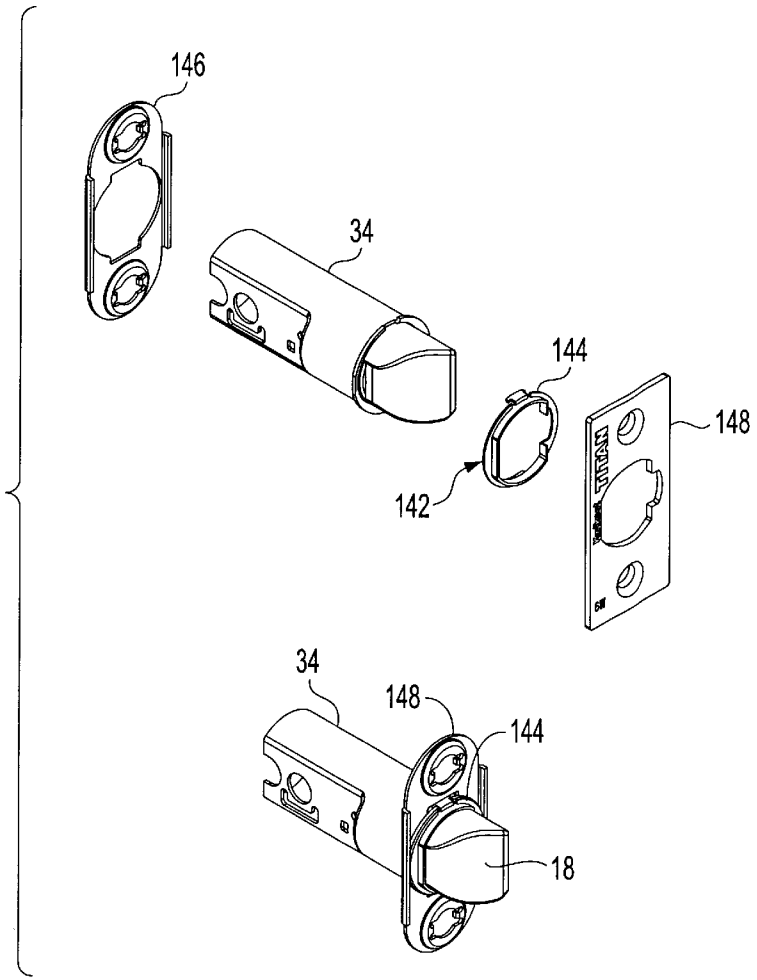
FIG. 9 is a set of enlarged perspective detail views showing the use of a low-friction sleeve in the bolt/latch front plate subassembly.
Figure 27:
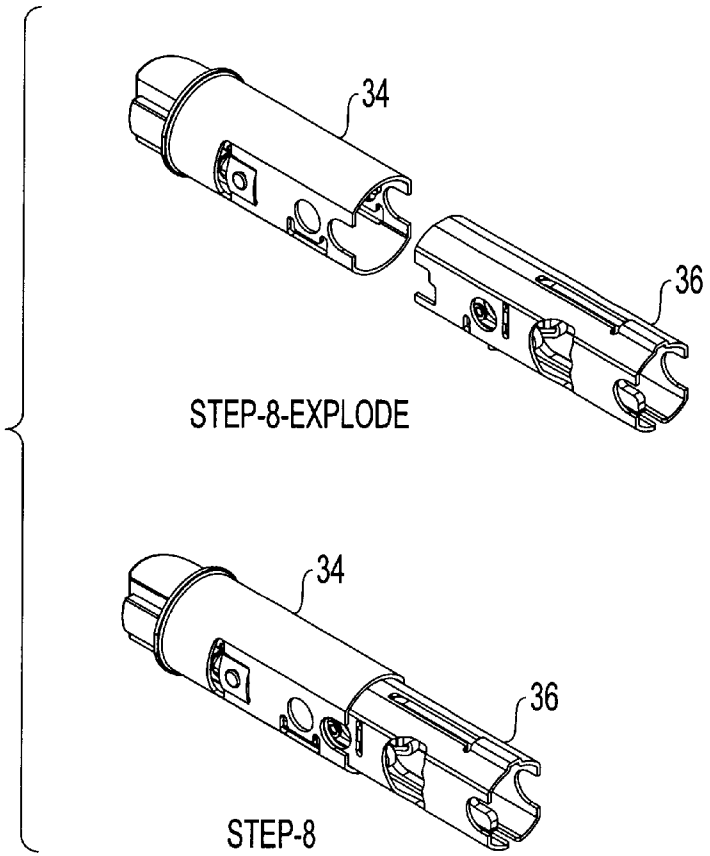
Figure 26:
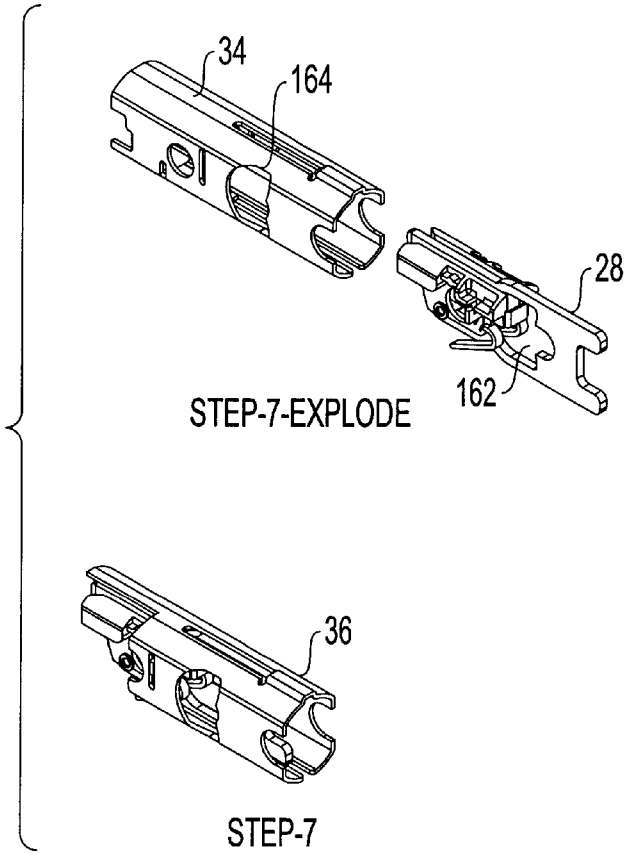

Now referring to FIG. 9, another plastic, low-friction element is shown. A low friction sleeve 142 which has an outer flange portion 144, and conforms to the configuration of the main bolt 18 and auxiliary bolt 20 mounted over outer case 34 so as to be in a butting relationship with a back plate 146 which in turn will ultimately be sandwiched against latch front 148. Note that this arrangement permits several styles of latch fronts to be used with the same latch system. Additional features of the adjustment backset latch system 10 of the present invention includes locating various clearance holes in the cases 34, 36 to be in registration with one another and with a clearance hole in adjuster 82. As will be seen, this contributes to a very compact system, while preserving sufficient metal in the latch parts to provide structural integrity. Clearance holes, rose post or bolt clearance holes 150, 152 are formed in both sides of the outer case 34 and the inner case 36, respectively, to accommodate the posts 154 of the rose as shown in FIG. 36. In addition, to accommodate the adjustment in backset, partial clearance holes 156 are also formed in the outer case 34. Note also that adjuster 82 defines in both of its portions 96, 96' a rose or bolt clearance hole 160. Now with reference to FIGS. 10 and 12, it can be seen that post holes 150 and 152 formed in the outer and inner cases 34, 36, respectively, are in registration with clearance hole 160 defined by the adjuster 82. Partial clearance hole 158 is formed in the rearmost portion of inner case 36 to accommodate the rearmost rose post or fastener. The assembly sequence of the adjuster backset latch system 10 of the present invention is illustrated in FIGS. 20 through 30. Note that in each of the figures an exploded view of the subassembly is shown in the upper portion, and the assembled view is shown in the lower drawing. First, the holder 108 is inserted into outer case 34. Then the deadlocking dog 118 is installed over the post 114 on the holder 108. Spring 54 is then placed over the top of the deadlocking dog 118. Spring 52 is then placed over the other protuberance post 116. Next, insert 138 is assembled to main bolt 18 followed by auxiliary bolt 20, and the bolt/auxiliary bolt subassembly is then inserted into the outer case 34. Next, front links 24, 26 are inserted through the rear of the outer case 34 and through the holder 108 via vertical aperture 112. Next, cam 40 with its cam pin 46 is inserted between the front links 24, 26 and hooked into the slot 50 formed in the rearward protrusion 48 of main bolt 18. After that, a rivet or pivot pin 42 is inserted through the aperture 110 in the holder, the holes 44 in the outer case and through the cam 40. Placing that subassembly aside, the back link 28 is placed between the two halves of the adjuster and pin 46 is inserted in slot 60 such that it rests in pockets 86, 86'. This is followed by inserting the subassembly of the adjuster 82, back link 28 and upper detent pin 46 into the inner case 36 so that the interior hole 162 of back link 28 is in registration with clearance aperture 164 formed in inner case 36. Then the inner case subassembly is inserted telescopically into the outer case subassembly, as shown in FIG. 27. Note at the bottom of FIG. 7, the registration of the various rose post and fastener holes formed in the cases 34, 36.

Figure 30:
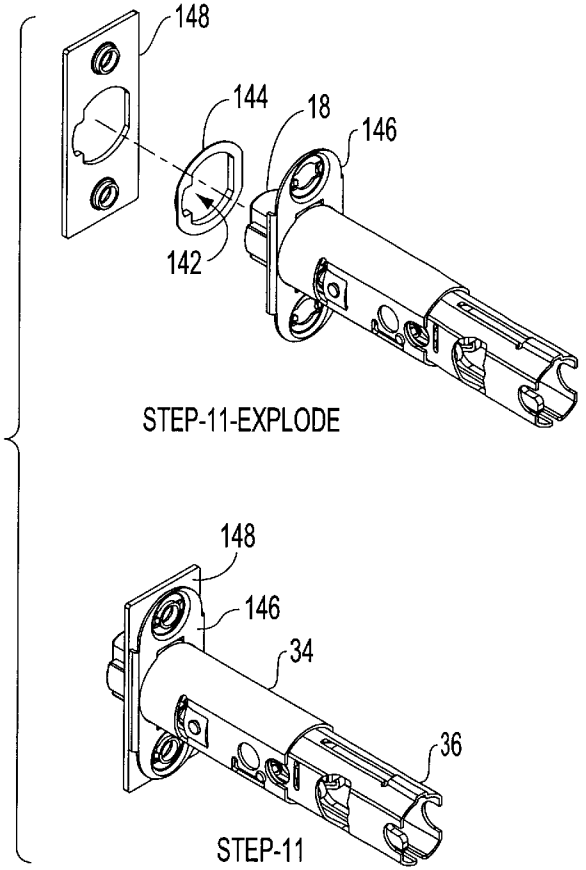
Figure 29:
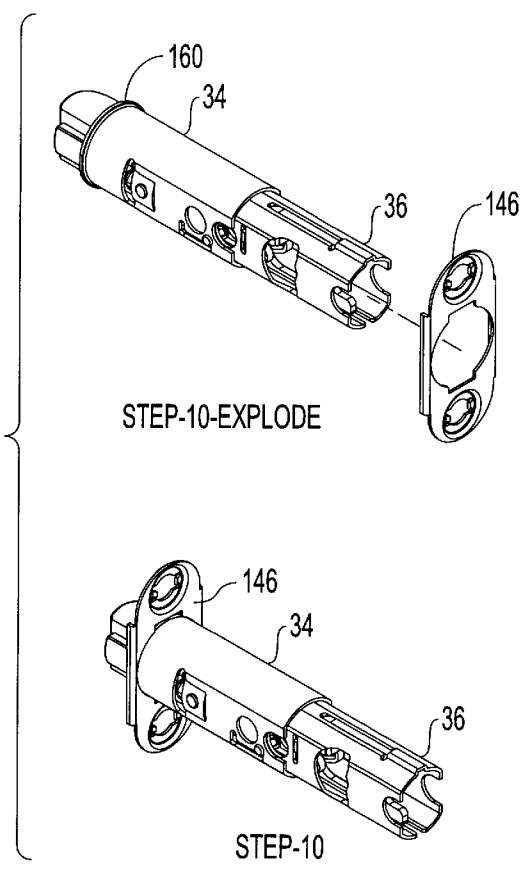
Figure 28:
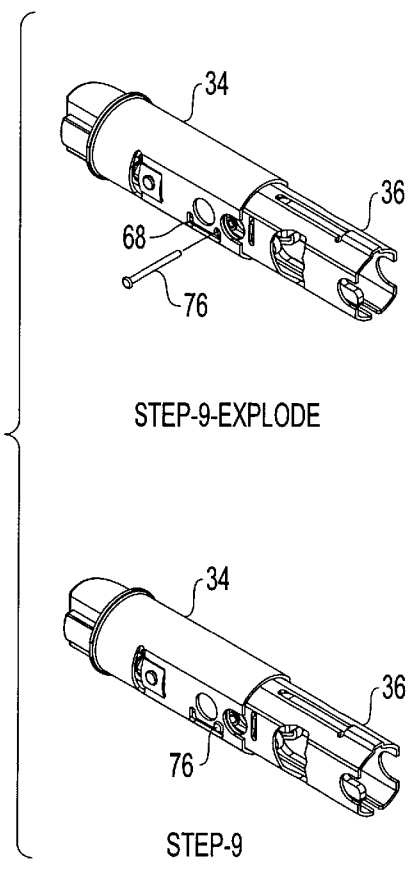

At this point, the lower detent pin or rivet 76 is pushed through the outer case 34, the adjuster 82, the back link 28 and the inner case 36. This step is followed by placing the back plate 146 over the outer case until seated on flange 160 formed on the outer case 34. Finally, as shown in FIG. 30, the sleeve 142 and front plate 148 are slipped over the bolt 18.

Figure 31:
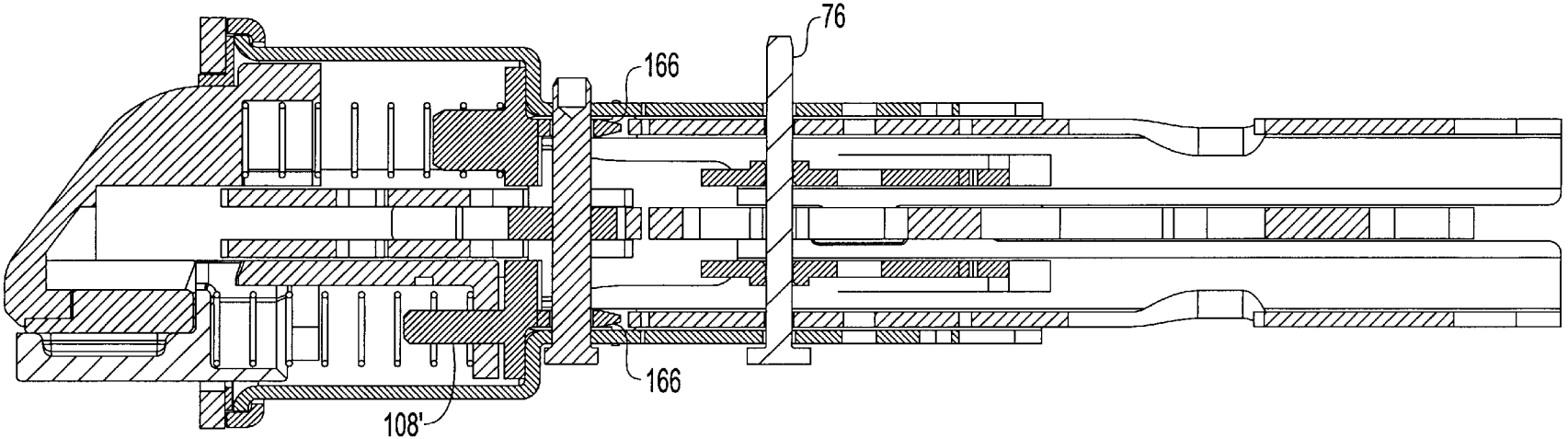
FIG. 31 is a sectional detail view of the adjustable backset latch mechanism of the present invention showing an alternative embodiment involving a different method of attaching the deadlocking dog holder to the outer case.
Figure 32:
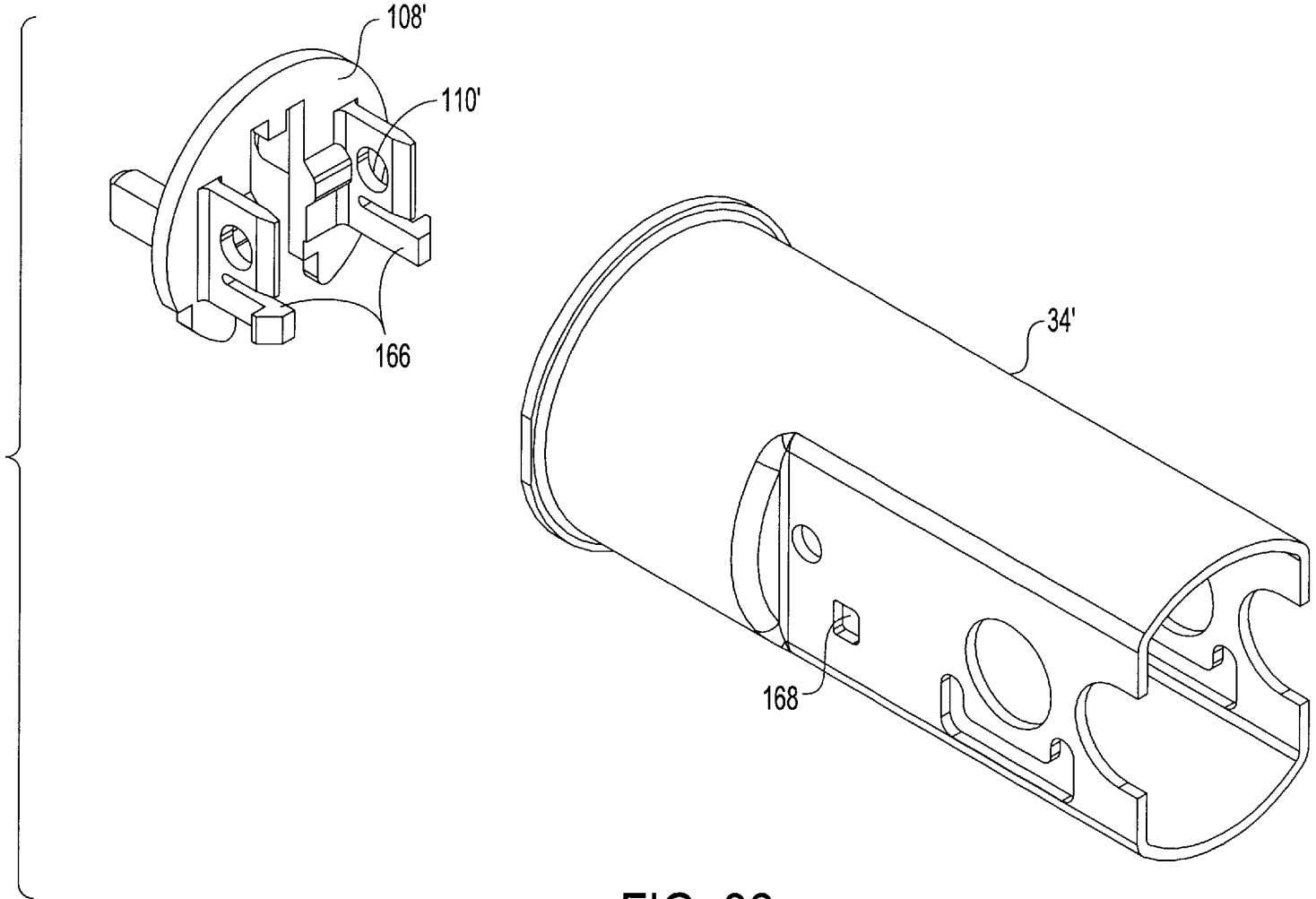
FIG. 32 is an exploded perspective detail view of the new outer case and holder configuration associated with the second embodiment of the present invention.
Figure 33:
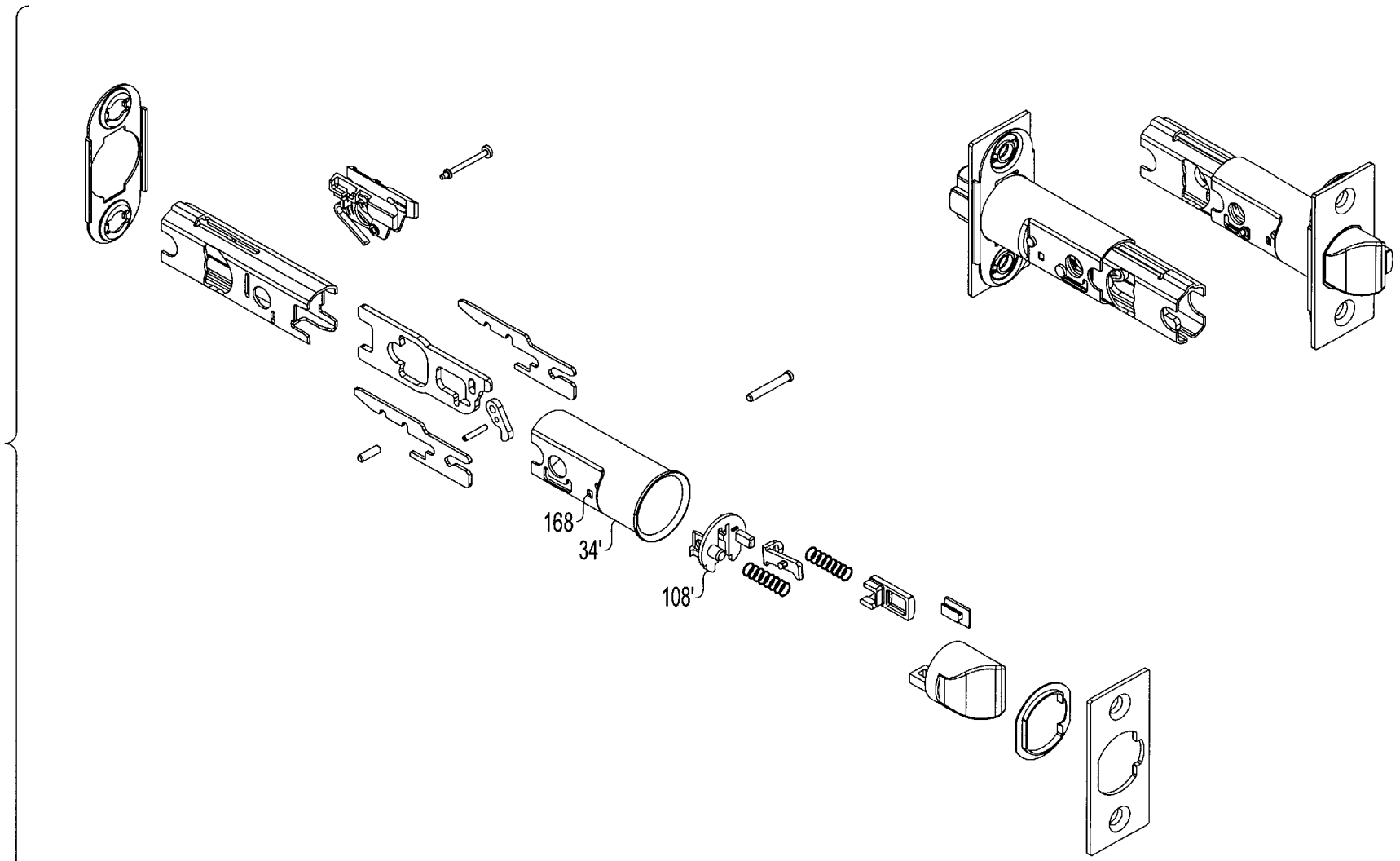
FIG. 33 is an exploded perspective detail view of the second embodiment of the adjustable backset latch mechanism of the present invention.
Figure 34:
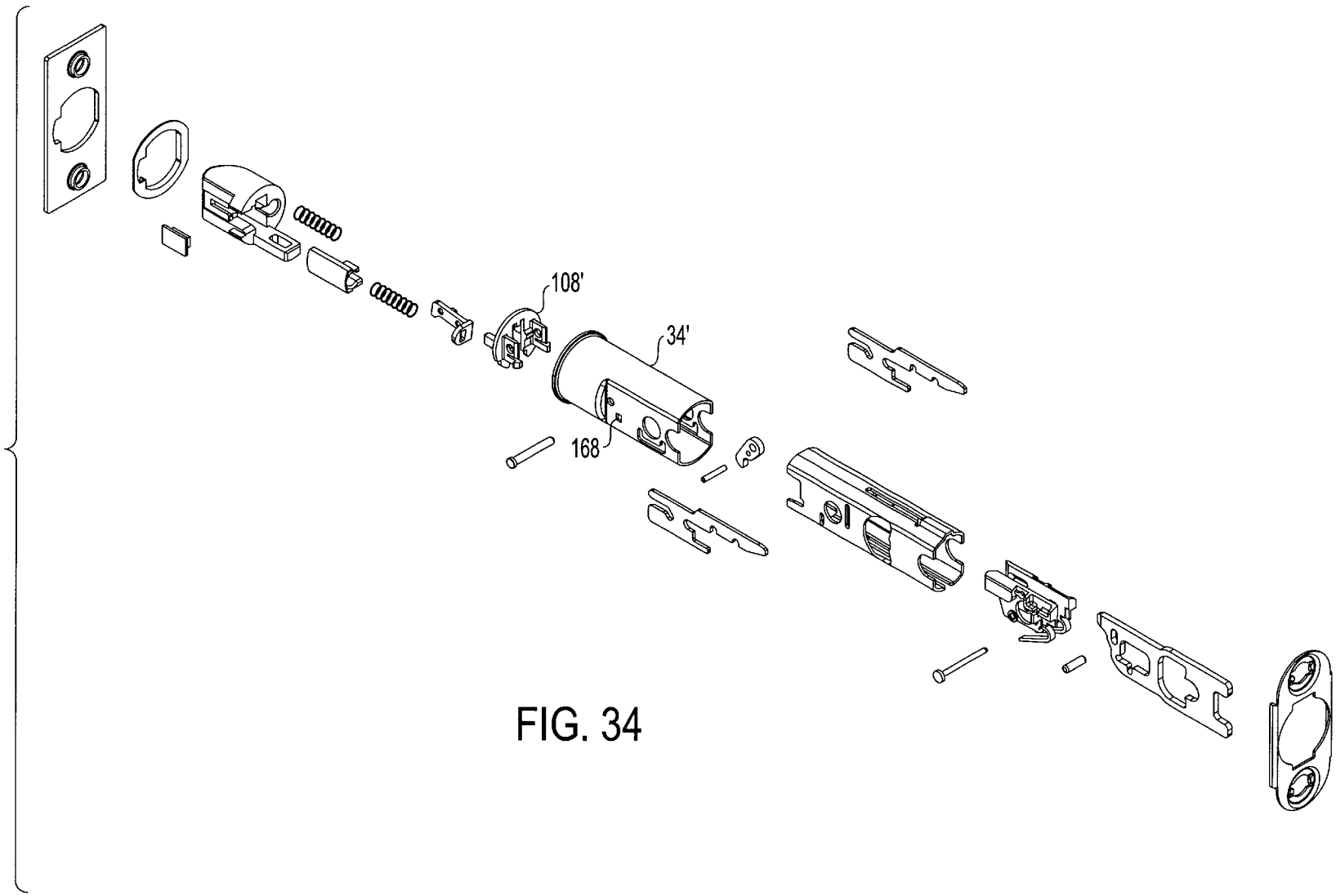
FIG. 34 is an exploded view, taken 180 degrees from the exploded view shown in FIG. 34, of the second embodiment of the adjustable backset latch mechanism of the present invention.

Additional embodiments of the present invention are illustrated in FIGS. 31 through 35. FIGS. 31 through 34 illustrate a latch subassembly with a different configuration in which the holder 108' for example has been modified to include spring clips 166 to engage holes 168 formed in the outer case 34'. Also, note that the holes 110 defined in the previous embodiment of the holder 108 of the present invention have been moved closer to the center of the holder 108' so that, as shown in FIG. 31, the holder subassembly now snaps into place and is more compact. FIG. 35 illustrates a plain latch of the embodiment of the present invention which does not use a deadlatching dog.

FIG. 36 is an exploded view of a lockset of the present invention incorporating the present invention.

The above-described embodiments, of course, are not to be construed as limiting the breadth of the present invention. Modifications, and other alternative constructions, will be apparent which are within the spirit and scope of the invention as defined in the appended claims.

What is claimed is:

1. A lockset having an adjustable-backset latch, comprising:

a bolt connected by a front link and a back link to a bolt operator;

the bolt operator operatively connected to at least one of a lever and a knob;

the bolt moveable in at least one of an outer case and an inner case from an extended position to a retracted position responsive to movement of said lever or said knob;

a unitary adjuster defining a resilient foot mounted in one of said inner and outer cases and releasably coupling said inner and outer cases and said front and back links, wherein the adjuster defines a resilient foot;

the inner and outer cases, and the front and back links, being adjustable in a predetermined backset increment upon uncoupling said cases and links; and the adjuster including a member which is engageable by a person to cause said adjuster both to uncouple said cases and links and to simultaneously adjust the spatial relationships of the links and cases by said backset increment.

2. A lockset having an adjustable-backset latch, comprising:

a bolt connected by a front link and a back link to a bolt operator;

the bolt operator operatively connected to at least one of a lever and a knob;

the bolt moveable in at least one of an outer case and an inner case from an extended position to a retracted position responsive to movement of said lever or said knob;

an adjuster mounted in one of said inner and outer cases and releasably coupling said inner and outer cases and said front and back links, said adjuster including two portions joined by a living hinge;

the inner and outer cases, and the front and back links, being adjustable in a predetermined backset increment upon uncoupling said cases and links; and the adjuster including a member which is engageable by a person to cause said adjuster both to uncouple said cases and links and to simultaneously adjust the spatial relationships of the links and cases by said backset increment.

3. The lockset claimed in claim 2, wherein:

said inner case is substantially cylindrical; and wherein said two adjuster portions are folded together at said living hinge and are mounted in said inner case.

4. A lockset having an adjustable-backset latch, comprising:

a bolt connected by a front link and a back link to a bolt operator;

the bolt operator operatively connected to at least one of a lever and a knob;

the bolt moveable in at least one of an outer case and an inner case from an extended position to a retracted position responsive to movement of said lever or said knob wherein one of said inner and outer cases defines a "U"-shaped slot, and the other of said cases defines a hole;

an adjuster mounted in one of said inner and outer cases and releasably coupling said inner and outer cases and said front and back links, wherein the adjuster carries a first detent pin and a second detent pin, wherein said second pin is carried in said hole in said other of said cases and is selectively moveable in said "U"-shaped slot in said one case and the arms of said "U" are separated by said backset increment;

the inner and outer cases, and the front and back links, being adjustable in a predetermined backset increment upon uncoupling said cases and links; and the adjuster including a member which is engageable by a person to cause said adjuster both to uncouple said cases and links and to simultaneously adjust the spatial relationships of the links and cases by said backset increment.

5. A lockset having an adjustable-backset latch, comprising:

a bolt connected by a front link and a back link to a bolt operator;

the bolt operator operatively connected to at least one of a lever and a knob;

the bolt moveable in at least one of an outer case and an inner case from an extended position to a retracted position responsive to movement of said lever or said knob;

an adjuster mounted in one of said inner and outer cases and releasably coupling said inner and outer cases and said front and back links, said adjuster carrying a first detent pin and a second detent pin;

the inner and outer cases, and the front and back links, being adjustable in a predetermined backset increment upon uncoupling said cases and links; and the adjuster including a member which is engageable by a person to cause said adjuster both to uncouple said cases and links and to simultaneously adjust the spatial relationships of the links and cases by said backset increment;

said front link defining two-downwardly-opening slots separated by said backset increment;

said first pin being carried wholly within said adjuster; and said second pin being carried by said adjuster to extend through a hole in said inner case and into a "U"-shaped slot in said outer case, the arms of said "U" being separated by said backset increment.

6. The lockset claimed in claim 5, wherein said adjuster defines a resilient portion normally urging said first pin in one of said downwardly-opening slots in said front link and said second pin in one of said legs of said "U"-shaped slot in said outer case.

7. The lockset claimed in claim 6, wherein:

said second pin includes a portion extending outwardly from said outer case and engageable by a person; whereby said pin may be moved to cause said cases and said links to be adjusted by said backset increment.

8. The lockset claimed in claim 7, wherein:

said back link is sandwiched between a pair of front links, each defining said downwardly-opening slots such that said first pin engages the slots of both front links; and said front case defines identical "U"-shaped slots on two opposite sides of the front case, the second pin riding in both "U"-shaped slots.

9. The lockset claimed in claim 7, wherein:

said back link defines an inner surface engageable by the bolt operator; and said bolt operator is rotatable in said lockset to engage said inner surface to cause said back link and front link to retract said bolt.

10. The method claimed in claim 7, wherein moving said first detent pin includes grasping a portion of said first detent pin.

11. The lockset claimed in claim 6, wherein:

said back link defines an upwardly-opening slot; whereby movement of said second pin downwardly in one of said legs of said "U" moves said first pin into said upwardly-opening slot; such that when said second pin travels the base of said "U", said second pin carries the back link with it, thereby adjusting said back link relative to said front link by said backset increment.

12. The lockset claimed in claim 11, wherein:

when said second pin is positioned in one of the legs of said "U" adjacent the base of said "U", and released, said second pin is biased out of engagement with said upperwardly-opening slot in said back link, and said first pin is biased into engagement with one of said downwardly-opening slots in said front link.

13. The lockset claimed in claim 11, wherein said inner case defines a clearance opening in registration with said inner surface to allow said bolt operator to extend through said inner case and said back link.

14. A lockset having an adjustable-backset latch, comprising:

a bolt connected by a front link and a back link to a bolt operator, said front link being connected to said bolt and defining a rearwardly-extending portion which defines a cam slot;

a cam pivotably connected to said outer case, said cam being engageable with said bolt via said cam slot to retract said bolt;

a spring normally biasing said bolt into said extended position;

the bolt operator operatively connected to at least one of a lever and a knob;

the bolt moveable in at least one of an outer case and an inner case from an extended position to a retracted position responsive to movement of said lever or said knob;

an adjuster mounted in one of said inner and outer cases and releasably coupling said inner and outer cases and said front and back links;

the inner and outer cases, and the front and back links, being adjustable in a predetermined backset increment upon uncoupling said cases and links;

the adjuster including a member which is engageable by a person to cause said adjuster both to uncouple said cases and links and to simultaneously adjust the spatial relationships of the links and cases by said backset increment;

a pivot pin pivotably connecting said cam to said outer case;

a cam pin carried by said cam; and a cam pin-engaging portion engaging surface formed on said front link for engagement with said cam pin; whereby retraction of said front link causes said cam pin-engaging surface to rotate said cam about said pivot pin.

15. The lockset claimed in claim 14, wherein:

said cam defines a bolt-engaging portion; and said bolt-engaging portion engages an interior surface of said bolt to retract said bolt when said cam is rotated.

16. The lockset claimed in claim 15, wherein said bolt-engaging portion and said cam pin are located on the same side of said cam relative to said pivot pin.

17. The lockset claimed in claim 15, wherein:

the bolt-engaging portion of said cam is spaced from said pivot pin a first distance and said cam pin is spaced from said pivot pin a second distance;

the first and second distances being selected such that the travel of the bolt operator is multiplied to retract the bolt.

18. The lockset claimed in claim 17, wherein said first and second distances are selected to multiply the movement of the bolt operator by about 2½ times.

19. A lockset having an adjustable-backset latch, comprising:

a bolt connected by a front link and a back link to a bolt operator;

the bolt operator operatively connected to at least one of a lever and a knob;

the bolt moveable in at least one of an outer case and an inner case from an extended position to a retracted position responsive to movement of said lever or said knob;

an adjuster mounted in one of said inner and outer cases and releasably coupling said inner and outer cases and said front and back links;

the inner and outer cases, and the front and back links, being adjustable in a predetermined backset increment upon uncoupling said cases and links;

the adjuster including a member which is engageable by a person to cause said adjuster both to uncouple said cases and links and to simultaneously adjust the spatial relationships of the links and cases by said backset increment; and a deadlatching system operatively associated with said bolt and said front link.

20. The lockset claimed in claim 19, wherein:

said deadlatching system includes a holder connected to said outer case, an auxiliary bolt operatively associated with said bolt and moveable from an extended position to a blocking position, and a deadlocking dog moveably mounted on said holder and operatively associated with said bolt and said deadlocking dog;

said bolts are normally biased in their respective extended positions; and said deadlocking dog are normally biased to interfere with the movement of said bolt to said retracted position when said auxiliary bolt is moved to said locking position.

21. The lockset claimed in claim 20, wherein:

said holder includes two forward-facing protuberances; and further comprising a first spring mounted on one of said protuberances and engaging said bolt to bias said bolt into its extended position;

said deadlocking dog is loosely mounted on said other of said protuberances for limited pivotable movement about said other of said protuberances; and further comprises a second spring connected between said auxiliary bolt and said deadlocking dog to normally pivot said deadlocking dog to interfere with retraction of said bolt.

22. The lockset claimed in claim 20, further comprising a low-friction member sandwiched between said bolt and said auxiliary bolt.

23. The lockset claimed in claim 19, wherein:

said auxiliary bolt includes a shelf portion;

said bolt defines a blocking portion;

said deadlocking dog includes a front portion;

said shelf maintains said front portion out of engagement with said bolt blocking portion when said auxiliary bolt is in its extended position; and said front portion engages said bolt blocking portion upon movement of said auxiliary bolt to said blocking position.

24. The lockset claimed in claim 23, wherein:

said deadlocking dog further includes a cam follower;

said front link defines a cam; wherein retraction of said front link cams said deadlocking dog out of blocking relationship with said bolt blocking portion.

25. The lockset claimed in claim 24, wherein retraction of said front link simultaneously retracts said bolt and cams said deadlocking dog out of blocking relationship with said bolt-blocking portion.

26. A method for adjusting the backset of an adjustable-backset latch, comprising:

moving a first detent pin along a slot formed in a first housing member from a first locking position to a first unlocking position relative to said first housing member to cause a second detent pin to move from a first locking state, locking two link members and said first housing member and a second housing member in a predetermined backset relationship, to an unlocking state;

moving said first detent pin along the slot from said first unlocking position to a second unlocking position to separate said two linking members and said housing members by a distance corresponding to an incremental change in said predetermined backset relationship; and moving said first detent pin to a second locking position relative to said first housing member to cause said second detent pin to move to a second locking state locking said two link members and said housing members in said changed backset relationship.

27. A method for changing the backset of an adjustable-backset latch assembly having a bolt mounted for extension from, and retracting into, a housing responsive to movement of a link, comprising:

simultaneously changing the respective lengths of said housing and said link by a predetermined backset increment without rotating either the housing or the link, wherein simultaneously changing said lengths includes moving a member connected to said link along a "U"-shaped slot formed in said housing.

28. A method of changing the backset of a latch having a bolt moveable in a housing and retractable by a link comprising:

grasping a member that extends from inside the housing outwardly through a "U"-shaped slot in said housing; and moving said member along said "U"-shaped slot without rotating either said bolt, said housing or said link.

29. The method claimed in claim 28, wherein:

said member is mounted in an adjuster operatively associated with said housing and said link; and wherein moving said member includes moving said adjuster through two vertical states relative to said link and two horizontal states relative to said housing.

30. A housing and link subassembly for an adjustable-backset latch assembly for a lockset, the latch assembly including a link and a bolt retractable in said housing responsive to movement of said link by a bolt operator in said lockset, comprising:

first and second substantially cylindrical housing members telescopically engaging one another and moveable relative to one another by a backset increment;

one of said housing members defining a first clearance hole;

the other of said housing members defining a second clearance hole and a bolt operator clearance hole, the first and second clearance holes being in registration;

the link defining an internal aperture portion engageable by said bolt operator; and said link internal aperture portion being in registration with said bolt operator clearance hole throughout the operation of said latch assembly, wherein said first housing member further defines a "U"-shaped slot below said first clearance hole and said "U"-shaped slot is operatively associated with said link.

31. An adjuster system for an adjustable-backset latch assembly for a lockset having a bolt retractable by a bolt operator, comprising:

a housing in which said bolt may be retracted;

a unitary adjuster mounted in said housing, the adjuster defining a clearance hole and an integral spring foot to normally bias the adjuster to a position preventing the backset to be adjusted; and said adjuster being moveable in said housing to adjust said backset without interfering with the action of said bolt operator to retract said bolt.

32. The system claimed in claim 31, wherein:

the plastic adjuster further defines a detent slot and a detent aperture; and further comprising:

first and second detents in said slot and aperture, respectively; wherein said first detent moves in said first slot responsive to retraction of said bolt by said bolt operator; and said second detent is graspable to move said adjuster.

33. The system claimed in claim 32, wherein said adjuster is formed of lubricous plastic.

34. A lockset having an adjustable-backset latch assembly, comprising:

an adjuster coupled to the latch assembly for moving the latch assembly between a first backset position and a second backset position, the adjuster including a unitary plastic body defining a two-part detent-holding portion, each part of the two-part detent-holding portion further including an integral spring foot portion.

35. The lockset claimed in claim 34, wherein said detent-holding portion defines a detent channel and a detent aperture.

36. The lockset claimed in claim 35, wherein said adjuster further defines a clearance aperture.

37. The lockset claimed in claim 35, wherein:

said body is defined by a pair of body portions;

the body portions are connected by a living hinge; and the body portions are folded together at said living hinge such that each body portion's detent channel and detent aperture are in registration with the other's.

38. The lockset claimed in claim 37, wherrein each body portion defines a spring foot portion.

39. A lockset having at least one of a knob and a handle, comprising:

a bolt retraction system operatively associated with at least one of said knob and handle;

said bolt retraction system including a housing, a bolt actuator moveable in the housing, and a bolt operator moveable in the housing and operatively associated with the bolt actuator;

the bolt retraction system further including a cam pivotally mounted in the housing and connected to the bolt actuator, the bolt actuator including a back link operatively associated with the operator and a front link operatively associated with the back link and the cam, the cam being connected to the housing via a pin about which the cam pivots, wherein a movement of the front link results in a movement of greater distance by the bolt than of the front link;

a bolt including a cam-engaging portion and moveable between an extended position and a retracted position; and a bias member normally urging the bolt into the extended position, the cam engaging the bolt cam-engaging portion to retract the bolt responsive to movement of the operator.

40. The system claimed in claim 39, wherein the distance between the bolt and the operator may be changed by changing the relationship of the front link to the back link.

41. A deadlatching system for a latch assembly, comprising:

a case;

a main bolt and an auxiliary bolt moveable relative to the main bolt;

a bolt actuator moveable in the case;

the main bolt moveable between an extended position and a retracted position relative to the case responsive to movement of the bolt actuator;

the main bolt and auxiliary bolt being normally biased in their extended positions;

a deadlocking dog pivotally connected to the case and having a first portion engageable with the main bolt, a second portion engageable with the auxiliary bolt, and a third portion engageable with the bolt actuator;

the deadlocking dog pivotable by retraction of the auxiliary bolt with the bolt extended to a position blocking retraction of the main bolt; and the deadlocking dog pivotable by the bolt actuator from a first position blocking the main bolt to a second position allowing the main bolt to retract.

42. The deadlatching system claimed in claim 41, wherein:

said deadlocking dog being biased to engage said main bolt to block retraction of said main bolt;

said auxiliary bolt including a shelf portion supporting said deadlocking dog when said auxiliary bolt is extended, and allowing said deadlocking dog to pivot to a bolt retraction-blocking position when said auxiliary bolt is retracted.

43. The deadlatching system claimed in claim 41, wherein the main bolt defines a blocking surface engageable by said deadlocking dog first portion.

44. The deadlatching system claimed in claim 41, wherein:

the bolt actuator defines a slot having a predetermined configuration; and the deadlocking dog includes a protuberance riding in said slot.

45. The deadlatching system claimed in claim 41, wherein:

said case including two forwardly-extending axial protuberances;

said deadlocking dog loosely mounted for pivotable movement on one of said protuberances; and further comprising a first spring between said deadlocking dog and said auxiliary bolt and normally biasing said auxiliary bolt to its extended position and said deadlocking dog to its bolt retraction-blocking position; and a second spring mounted on the other of said protuberances between said case and said main bolt for normally biasing said main bolt in its extended position.

46. A bolt subassembly, comprising:

a case;

a main bolt axially moveable in the case;

the main bolt defining a sliding face;

an auxiliary bolt slideably engaging the main bolt sliding face;

an insert having a contact face and formed on the main bolt sliding face;

the insert contact face being substantially flush with the main bolt sliding face; and the insert formed of material having a low coefficient of friction relative to the main bolt sliding face.

47. A method for preventing retraction of a main bolt in a latch subassembly having an auxiliary bolt, comprising:

biasing a deadlocking dog connected to a housing to pivot to a main bolt retraction-blocking position;

retracting said auxiliary bolt such that a shelf formed on said auxiliary bolt for preventing said pivoting of said deadlocking dog no longer engages said deadlocking dog; and allowing said deadlocking dog to pivot to said main bolt retraction-blocking position.

48. A method for allowing retraction of a main bolt in a latch subassembly having an auxiliary bolt and a bolt actuator operatively associated with said main bolt, comprising:

synchronizing the retraction of said main bolt and said auxiliary bolt such that said bolt actuator removes a deadlocking dog from blocking engagement with said main bolt while both said main bolt and said auxiliary bolt are in motion.

49. The method claimed in claim 48, wherein said main bolt is fully retracted, said deadlocking dog is received within a cavity in said main bolt.

50. A method for assembling a latch subassembly for a lockset, comprising:

mounting a holder onto an outer case;

mounting a deadlocking dog onto said holder;

mounting a first spring onto said deadlocking dog;

mounting a second spring onto said holder; and assembling an auxiliary bolt and a main bolt into said outer case such that said first spring bears against said auxiliary bolt and biases said deadlocking dog to pivot in a direction to interfere with retracting said main bolt, and said second spring bears against said main bolt.

51. The method claimed in claim 50, wherein said holder defines an opening, and further comprising:

assembling a front link subassembly;

inserting said front link subassembly into said outer case and through said holder opening;

placing a cam member into said front link subassembly such that a portion of said cam engages said main bolt so as to retract said main bolt when said cam is actuated by said front link subassembly; and inserting a fastener through said holder, outer case, and cam member.

52. The method claimed in claim 51, further comprising:

assembling an adjuster to a back link;

inserting a first pin into a hole formed in said back link such that said pin rests in pockets in said adjuster;

inserting said adjuster, back link and pin into an inner case such that a clearance hole formed in said adjuster is in registration with a clearance hole in said inner case; and assembling the inner case subassembly to the outer case subassembly.

53. The method claimed in claim 52, further comprising:

inserting a second pin through said outer case, adjuster, back link and inner case;

placing a back plate over said outer case until said back plate is seated upon a flange formed on said outer case; and placing a plastic sleeve and a front plate over said bolt so as to be adjacent said front plate.

* * * * *